US009284791B2

(12) United States Patent
Angelle et al.

(10) Patent No.: US 9,284,791 B2
(45) Date of Patent: Mar. 15, 2016

(54) APPARATUS AND METHOD TO CLEAN A TUBULAR MEMBER

(71) Applicants: Jeremy Richard Angelle, Youngsville, LA (US); Logan Essex Smith, Youngsville, LA (US); Robert Thibodeaux, Jr., Lafayette, LA (US)

(72) Inventors: Jeremy Richard Angelle, Youngsville, LA (US); Logan Essex Smith, Youngsville, LA (US); Robert Thibodeaux, Jr., Lafayette, LA (US)

(73) Assignee: Frank's International, LLC, Houston, TX (US)

( * ) Notice: Subject to any disclaimer, the term of this patent is extended or adjusted under 35 U.S.C. 154(b) by 458 days.

(21) Appl. No.: 13/718,528

(22) Filed: Dec. 18, 2012

(65) Prior Publication Data

US 2013/0153303 A1 Jun. 20, 2013

Related U.S. Application Data

(63) Continuation-in-part of application No. 13/331,790, filed on Dec. 20, 2011, now Pat. No. 9,033,034, which is a continuation-in-part of application No. 13/331,759, filed on Dec. 20, 2011.

(51) Int. Cl.

| | |
|---|---|
| ***E21B 12/06*** | (2006.01) |
| ***E21B 19/10*** | (2006.01) |
| ***B08B 9/023*** | (2006.01) |
| ***E21B 17/00*** | (2006.01) |

(52) U.S. Cl.

CPC ..... *E21B 17/006* (2013.01); *B08B 9/023* (2013.01); *E21B 12/06* (2013.01); *E21B 19/10* (2013.01); *Y10T 29/49826* (2015.01)

(58) Field of Classification Search

CPC ..... E21B 33/08; E21B 17/006; E21B 37/00; E21B 12/06; B08B 9/023

See application file for complete search history.

(56) References Cited

U.S. PATENT DOCUMENTS

| | | | | | |
|---|---|---|---|---|---|
| 1,521,390 | A | * | 12/1924 | Reynolds | 166/312 |
| 2,960,706 | A | * | 11/1960 | Dunham | 15/4 |
| 3,306,310 | A | * | 2/1967 | Grant | 134/122 R |
| 3,378,088 | A | * | 4/1968 | Grant et al. | 175/84 |
| 3,475,781 | A | * | 11/1969 | Grant | 15/220.4 |
| 3,943,997 | A | * | 3/1976 | Davis | 166/312 |
| 4,279,300 | A | * | 7/1981 | Wirsch | 166/90.1 |
| 4,433,639 | A | * | 2/1984 | Brown | 118/316 |
| 4,449,596 | A | | 5/1984 | Boyadjieff | |
| 4,457,366 | A | * | 7/1984 | Brown | 175/84 |
| 4,494,607 | A | * | 1/1985 | Ford et al. | 166/311 |
| 4,619,321 | A | * | 10/1986 | Molina | 166/90.1 |
| 4,640,372 | A | * | 2/1987 | Davis | 175/208 |
| 4,690,213 | A | | 9/1987 | Stannard et al. | |
| 4,895,205 | A | * | 1/1990 | Thompson et al. | 166/90.1 |
| 5,085,016 | A | * | 2/1992 | Rose | 451/92 |
| 5,101,896 | A | * | 4/1992 | Thompson et al. | 166/90.1 |

(Continued)

OTHER PUBLICATIONS

International Search Report and Written Opinion issued in Application No. PCT/US2012/070500, dated Apr. 26, 2013 (18 pages).

(Continued)

*Primary Examiner* — Blake Michener

(74) *Attorney, Agent, or Firm* — Osha Liang LLP

(57) ABSTRACT

A system to clean a tubular member includes an apparatus to support a tubular member having a bore with a longitudinal axis extending therethrough, and a fluid dispensing system disposed adjacent to an opening of the apparatus, the fluid dispensing system having a nozzle to dispense fluid therefrom.

23 Claims, 14 Drawing Sheets

(56) References Cited

U.S. PATENT DOCUMENTS

| | | | | |
|---|---|---|---|---|
| 5,172,450 | A * | 12/1992 | Cole et al. | 15/302 |
| 5,526,877 | A | 6/1996 | Winz | |
| 5,642,793 | A | 7/1997 | Ljøsne | |
| 6,059,052 | A | 5/2000 | Haggard | |
| 7,409,995 | B2 * | 8/2008 | Moynahan | 166/311 |
| 7,762,343 | B2 | 7/2010 | Sonneveld et al. | |
| 8,028,750 | B2 | 10/2011 | Hughes et al. | |
| 8,316,929 | B2 * | 11/2012 | Angelle et al. | 166/77.1 |
| 8,443,893 | B1 * | 5/2013 | Finger et al. | 166/312 |
| 2006/0111022 | A1 * | 5/2006 | Sela et al. | 451/38 |
| 2008/0035333 | A1 | 2/2008 | Newman | |
| 2010/0116558 | A1 | 5/2010 | Angelle et al. | |
| 2010/0270033 | A1 * | 10/2010 | Angelle et al. | 166/380 |
| 2010/0294314 | A1 * | 11/2010 | Daleside | 134/21 |
| 2011/0220151 | A1 * | 9/2011 | Swinford | 134/22.12 |

OTHER PUBLICATIONS

Office Action in corresponding U.S. Appl. No. 13/331,759 dated Nov. 20, 2014 (28 pages).

Office Action for corresponding U.S. Appl. No. 13/331,790, mailed Nov. 7, 2013 (15 pages).

Office Action in related U.S. Appl. No. 13/331,790, mailed Oct. 2, 2014 (15 pages).

Office Action in related U.S. Appl. No. 13/331,759, mailed Aug. 24, 2015 (20 pages).

* cited by examiner

APPARATUS AND METHOD TO CLEAN A TUBULAR MEMBER

CROSS-REFERENCE TO RELATED APPLICATIONS

The present application is a continuation-in-part of, and therefore claims benefit under 35 U.S.C. §120 to, U.S. patent application Ser. No. 13/331,759 ("the '759 Application"), filed on Dec. 20, 2011, and is a continuation-in-part of, and therefore claims benefit under 35 U.S.C. §120 to, U.S. patent application Ser. No. 13/331,790 ("the '790 Application"), also filed on Dec. 20, 2011. All priority applications are hereby expressly incorporated by reference in their entirety.

BACKGROUND OF DISCLOSURE

1. Field of the Disclosure

Embodiments disclosed herein generally relate to methods and apparatuses to at least partially clean a tubular member. More specifically, embodiments disclosed herein relate to an apparatus that is used to support a tubular member and clean tubular members as the tubular members are removed from a downhole well location.

2. Background Art

In oilfield exploration and production operations, various oilfield tubular members are used to perform important tasks, including, but not limited to, drilling the wellbore and casing a drilled wellbore. For example, a long assembly of drill pipes, known in the industry as a drill string, may be used to rotate a drill bit at a distal end to create the wellbore. Furthermore, after a wellbore has been created, a casing string may be disposed downhole into the wellbore and cemented in place to stabilize, reinforce, or isolate (among other functions) portions of the wellbore. As such, strings of drill pipe and casing may be connected together, such as end-to-end by threaded connections, in which a female "pin" member of a first tubular member is configured to threadably engage a corresponding male "box" member of a second tubular member. Alternatively, a casing string may be made-up of a series of male-male ended casing joints coupled together by female-female couplers. The process by which the threaded connections are assembled is called "making-up" a threaded connection, and the process by which the connections are disassembled is referred to "breaking-out" the threaded connection. As would be understood by one having ordinary skill, individual pieces (or "joints") of oilfield tubular members may come in a variety of weights, diameters, configurations, and lengths.

Referring to FIG. 1, a perspective view is shown of one embodiment of a drilling rig 101 used to run one or more tubular members 111 (e.g., casing, drill pipe, etc.) downhole into a wellbore 113. As shown, the drilling rig 101 includes a frame structure known as a "derrick" 102, from which a traveling block 103 (which may include a top drive) suspends a lifting apparatus 105 (e.g., an elevator or a tubular (e.g., casing) running tool connected to the quill of a top drive) and a gripping apparatus 107 (e.g., slip assembly or "spider") at the rig floor may be used to manipulate (e.g., raise, lower, rotate, hold, etc.) a tubular member 111. The traveling block 103 is a device that is suspended from at or near the top of the derrick 102, in which the traveling block 103 may move up-and-down (i.e., vertically as depicted) to raise and/or lower the tubular member 111. The traveling block 103 may be a simple "pulley-style" block and may have a hook from which objects below (e.g., lifting apparatus 105 and/or top drive) may be suspended. Drilling rig 101 can be a land or offshore rig (e.g., drill ship) without departing from the scope of the present disclosure.

Additionally, the lifting apparatus 105 may be coupled below the traveling block 103 (and/or a top drive if present) to selectively grab or release a tubular member 111 as the tubular member 111 is to be raised and/or lowered within and from the derrick 102. As such, the top drive may include one or more guiding rails and/or a track disposed adjacent to the top drive, in which the guiding rails or track may be used to support and guide the top drive as the top drive is raised and/or lowered within the derrick. An example of a top drive is disclosed within U.S. Pat. No. 4,449,596, filed on Aug. 3, 1982, and entitled "Drilling of Wells with Top Drive Unit," which is incorporated herein by reference.

Typically, a lifting apparatus 105 includes movable gripping members (e.g., slip assemblies) attached thereto and movable between a retracted (e.g., disengaged) position and an engaged position. In the engaged position, the lifting apparatus 105 supports the tubular member 111 such the tubular member 111 may be lifted and/or lowered, and rotated if so equipped, e.g., by using a lifting apparatus that is a tubular (e.g., casing) running tool connected to the quill of the top drive. In the retracted position, the lifting apparatus 105 may release the tubular member 111 and move away therefrom to allow the tubular member 111 to be engaged with or removed from the lifting apparatus 105 and/or the gripping apparatus 107. For example, the lifting apparatus 105 may release the tubular member 111 after the tubular member 111 is threadably connected to a tubular string 115 supported by the gripping apparatus 107 (e.g., slip assembly or "spider") at the rig floor at the floor of the drilling rig 101.

Further, in an embodiment in which the drilling rig 101 includes a top drive and a tubular running tool, the tubular member 111 may be supported and gripped by the tubular running tool connected to the quill of the top drive. For example, the tubular running tool may include one or more gripping members that may move radially inward and/or radially outward. In such embodiments, these gripping members of a tubular running tool may move radially outward to grip an internal surface of the tubular member 111, such as with an internal gripping device and/or the gripping members of the tubular running tool may move radially inward to grip an external surface of the tubular member 111, such as with an external gripping device, however so equipped.

As such, the gripping apparatus 107 of the drilling rig 101 may be used to support and suspend the tubular string 115, e.g., by gripping, from the drilling rig 101, e.g., supported by the rig floor 109 or by a rotary table thereof. The gripping apparatus 107 may be disposed within the rig floor 109, such as flush with the rig floor 109, or may extend above the rig floor 109, as shown. As such, the gripping apparatus 107 may be used to suspend the tubular string 115, e.g., while one or more tubular members 111 are connected or disconnected from the tubular string 115.

The illustrated gripping device 201 includes a bowl 203 with a plurality of slip assemblies 205 movably disposed therein. Specifically, the slip assemblies 205 may be connected to a ring 207, in which the ring 207 may be connected to the bowl 203 through an actuator (e.g., actuator rods) 209. Actuator may be actuated, such as electrically actuated and/or fluidly (e.g., hydraulically) actuated, to move up and/or down with respect to the bowl 203, in which the slip assemblies 205 connected to the ring 207 may correspondingly move up and/or down with respect to the bowl 203.

The illustrated slip assemblies 205 are designed to engage and contact the inner tapered surface of the bowl 203 when moving with respect to the bowl 203. Bowl 203 is shown as a continuous surface but may comprise non-continuous surfaces (e.g., a surface adjacent to the rear of each slip assembly 205). Thus, as the slip assemblies 205 move up or down with respect to the bowl 203, the slip assemblies 205 may travel down along an inner surface of the bowl 203. With this movement, an inner surface (e.g., die) of the slip assemblies 205 will grip a tubular member 211 disposed within the gripping device 201. The slip assemblies 205 may have a gripping surface (e.g., teeth) on the inner surface to facilitate the gripping of the tubular member 211. After the tubular member 211 is supported by the gripping device 201, additional tubular members may be connected or disconnected from the tubular member 211.

As shown with respect to FIGS. 2A and 2B, the gripping device 201 may be used to grip tubular members 211 having multiple outer diameters. For example, as shown in FIG. 2A, the slip assemblies 205 may be positioned within the bowl 203 of the gripping device 201 to grip a tubular member 211A having a first diameter D1. As discussed, the slip assemblies 205 may be positioned using the ring 207 that may be vertically moveable, e.g., through the actuator rods 209. FIG. 2B shows gripping device 201, in which the slip assemblies 205 are positioned vertically higher within the bowl 203 with respect to the positioning of the slip assemblies 205 shown in FIG. 2A. As such, this positioning of the slip assemblies 205 in FIG. 2B enables the gripping device 201 to grip another tubular member 211B, in which the tubular member 211B has a second outer diameter D2 larger than the first outer diameter D1 of the tubular member 211A (for example, where D1 and D2 are on a tubular body itself and not a connector portion thereof). Thus, gripping device 201 may grip tubular members 211 having a large range of outer diameters without the need of reconfiguration and/or adding supplemental equipment to the gripping device 201. For example, in one embodiment, the second outer diameter D2 may be at least 145 percent larger (or smaller) than the first outer diameter D1.

From time-to-time, the drillstring must be raised or "tripped" out of the hole, such as when changing the drill bit at the end of the string. As the drillstring is brought out of the hole, the various tubular members are removed from the string and set aside in or around the drilling rig. However, when doing this, the tubular members may have drilling fluids and/or debris deposited thereon, such as oil or water-based mud and cuttings from the drilled underground formations.

For example, when drilling downhole, the cuttings formed from the borehole with the drill bit at the bottom of the string may need to be removed from the wellbore, and the well head may need to be maintained at a predetermined hydrostatic pressure. Drilling mud is then pumped down through a bore of the drill pipe where the mud exits the drill bit, and is circulated back uphole in the annular space between the drill pipe and the borehole. As such, as the string of tubular members is brought up and removed from the wellbore, mud, whether oil-based or water-based mud, may cling to the outer surface of the tubular members.

One way to remove drilling mud from the tubular members is to have a drilling rig crew member wash down the tubular members with a hose or the like as the tubular members emerge from the borehole. However, this may lead to a loss of valuable drilling fluid that may otherwise be reused in the drilling process, or may further lead to having mud being cast off and onto the rig floor and/or in the areas of the pipe handling equipment, presenting both concerns related to the safety of the workers and concerns related to the proper maintenance of the equipment in the rig. In addition, water used to clean the tubular members may dilute the drilling fluid in the wellbore and affect the mud weight.

Another way to remove mud from the tubular members is to include a one-piece wiper with the pipe handling equipment, in which the wiper may be used to remove excess mud from tubular members passing through the pipe handling equipment. However, this may lead to the wiper wearing out more rapidly, as the wiper may be engaging and wiping the outer surface of the tubular members when passing the tubular members both downhole and uphole. Furthermore, these wipers may not be readily accessible or removable, and therefore may require a significant amount of downtime within the drilling rig to replace the wipers.

Further, generally a pipe string may be disposed and suspended within a borehole from a drilling rig using a pipe handling apparatus, such as a spider, in which the pipe string may be lengthened step-wise by threadably joining a tubular segment to the proximal end of the pipe string at the rig. The pipe string may be suspended within the drilling rig using a second type of pipe handling apparatus, such as an elevator, that is movably supported from a draw works and a derrick above the spider. As the load of the pipe string is transferred between the spider and the elevator, the spider may be unloaded and then disengaged from the pipe string by retraction of the slips within the spider. The lengthened pipe string may then be lowered further into the borehole using the draw works controlling the elevator. The spider may then again engage and support the pipe string within the borehole and an additional tubular segment may be joined to the new proximal end of the pipe string to further lengthen the pipe string.

Lengthening a pipe string generally involves adding one tubular segment at a time to an existing pipe string. Similarly, reducing the length of a pipe string generally involves a reverse process in which one tubular segment at a time is removed from the existing pipe string. Accordingly, each tubular member disposed downhole and returned back uphole from the well may pass through and be handled by one or more pipe handling apparatuses, such as the spider and/or the elevator. However, after handling a large number of tubular segments and supporting the weight of the pipe string, one or more components of the pipe handling apparatuses may require maintenance to ensure that the pipe handling apparatuses are working properly and will continue to work properly.

As such, to reduce the wear on a pipe handling apparatus, a pipe guide may be disposed adjacent to one or both of the openings of the pipe handling apparatus to ensure that the tubular members being received within the pipe handling apparatus are in proper alignment and position. While, the pipe guides themselves may be subject to wear, such as from hard-banding, misalignments, hang-ups while disposed tubular members downhole or pulling them back uphole, etc, it may be easier to inspect and replace a pipe guide, as compared to inspecting and replacing the entire pipe handling apparatus.

For example, a pipe guide may be disposed adjacent to the top opening and/or the bottom opening of a spider, in which the pipe guides may be replaced as needed. For the top pipe guide of the spider, a visual inspection of the pipe guide may be enough to determine if the top pipe guide needs replacing. However, it may be more complicated to determine if the bottom pipe guide requires replacing, as the bottom pipe guide may be disposed below the rig floor such that visual inspection may be difficult, or impossible for that matter. Accordingly, a need may exist to address one or more of these concerns.

SUMMARY OF CLAIMED SUBJECT MATTER

In one aspect, embodiments disclosed herein relate to an apparatus to wipe a tubular member. The apparatus includes a first wiper section and a second wiper section, in which the first wiper section and the second wiper section are movable with respect to each other towards a point of convergence.

In another aspect, embodiments disclosed herein relate to an apparatus to wipe a tubular member. The apparatus includes a base having an aperture formed therein to receive the tubular member, and a first wiper section and a second wiper section connected to the base and movable with respect to the base between an open position and a closed position.

In another aspect, embodiments disclosed herein relate to a method to manufacture an apparatus to wipe a tubular member. The method includes connecting a first wiper section to a base, and connecting a second wiper section to the base, in which the first wiper section and the second wiper section are movable with respect to each other.

In yet another aspect, embodiments disclosed herein relate to an apparatus to wipe a tubular member. The apparatus includes a first means for wiping the tubular member and a second means for wiping the tubular member, in which the first wiping means and the second wiping means are movable with respect to each other towards a point of convergence.

In another aspect, embodiments disclosed herein relate to a system to grip a tubular member. The system includes a pipe handling apparatus having a bore formed therein with an axis defined therethrough, a pipe guide disposed adjacent to an opening of the bore of the pipe handling apparatus, and a wear sensor coupled to the pipe guide.

In another aspect, embodiments disclosed herein relate to a method to manufacture an apparatus to sense wear for a pipe handling apparatus. The method includes connecting a pipe guide to a base, the base configured to be connected to the pipe handling apparatus, and coupling a wear sensor to the pipe guide, the wear sensor configured to determine a predetermined amount of wear for the pipe guide.

In another aspect, embodiments disclosed herein relate to a method to sense wear within a pipe guide disposed adjacent to a pipe handling apparatus. The method includes guiding a tubular member into the pipe handling apparatus with the pipe guide, and sensing with a wear sensor coupled to the pipe guide that the pipe guide has received a predetermined amount of wear.

In yet another aspect, embodiments disclosed herein relate to a system to grip a tubular member. The system includes means for handling the tubular member, means for guiding the tubular member into the handling means, the guiding means disposed adjacent to an opening of the handling means, and means for sensing wear of the guiding means, the sensing means coupled to the guiding means.

Further, in one aspect, embodiments disclosed herein relate to a system to clean a tubular member. The system includes an apparatus to support a tubular member having a bore with a longitudinal axis extending therethrough, and a fluid dispensing system disposed adjacent to an opening of the apparatus, the fluid dispensing system having a nozzle to dispense fluid therefrom.

In another aspect, embodiments disclosed herein relate to an apparatus to clean a tubular member. The apparatus includes a bowl forming a bore and having a tapered inner wall formed about a longitudinal axis, a plurality of slip assemblies movably disposed within the bowl, and a fluid dispensing system disposed adjacent to an opening of the bowl, the fluid dispensing system having a plurality of nozzles to dispense fluid therefrom.

In another aspect, embodiments disclosed herein relate to a method to manufacture a system to clean a tubular member. The method includes providing an apparatus having a bore with a longitudinal axis extending therethrough to support the tubular member, and disposing a fluid dispensing system adjacent to an opening of the apparatus, the fluid dispensing system having a nozzle to dispense fluid therefrom.

Other aspects and advantages of the invention will be apparent from the following description and the appended claims.

DETAILED DESCRIPTION

Figure 1:
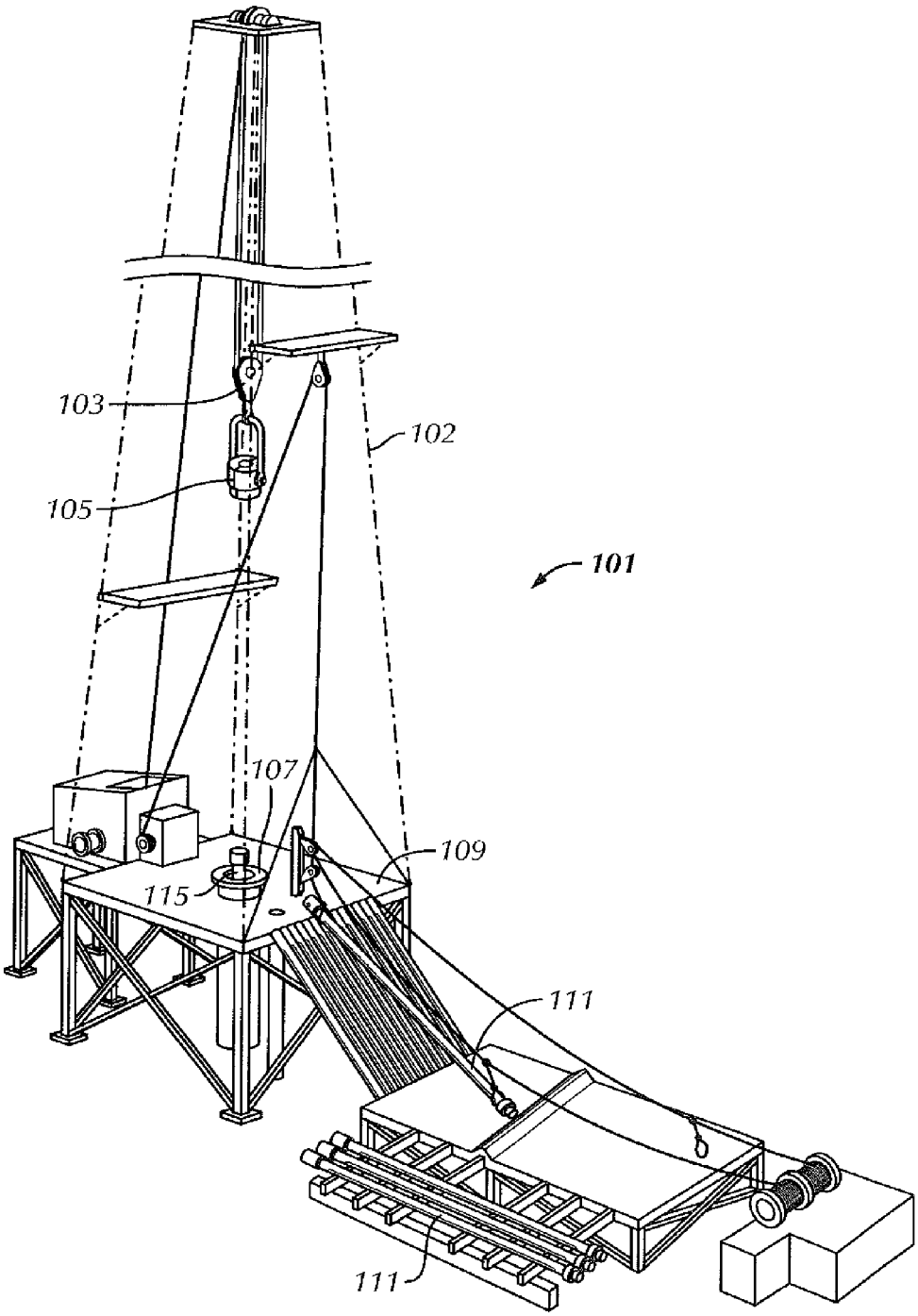
FIG. 1 is a schematic view of a drilling rig.
Figure 2A:
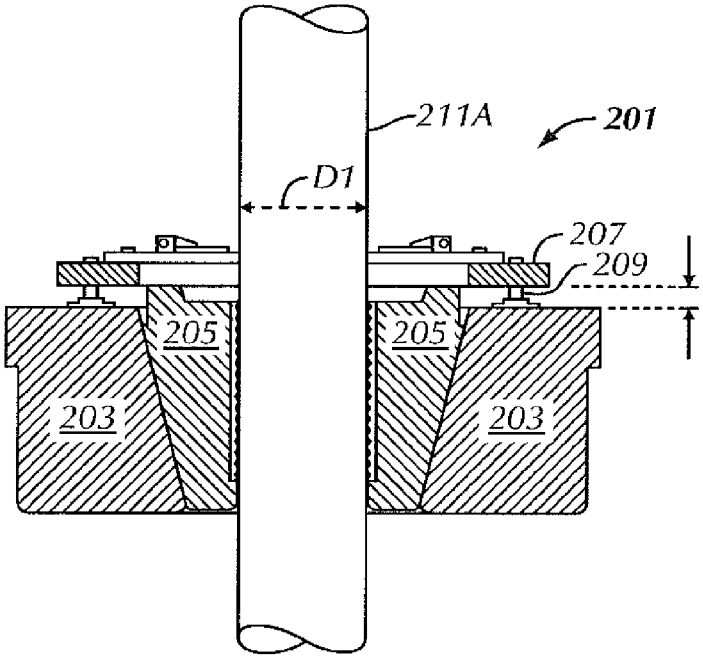
FIGS. 2A and 2B show perspective views of a gripping apparatus disposed within a drilling rig.
Figure 2B:
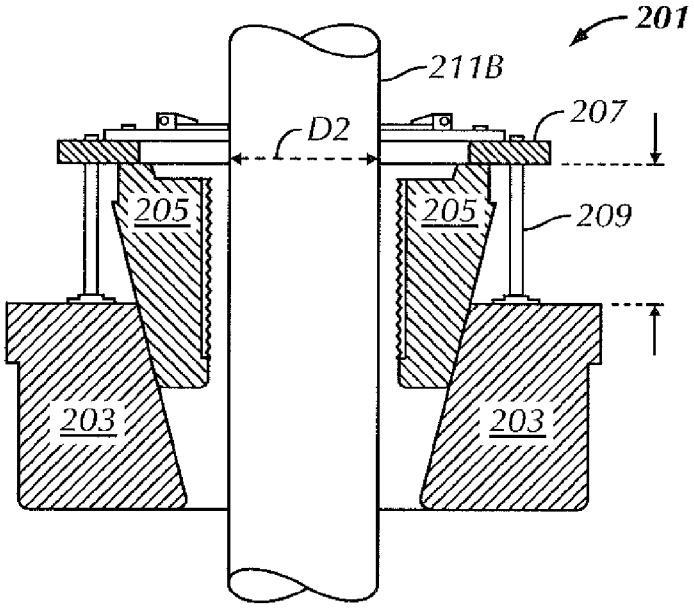

Specific embodiments of the present disclosure will now be described in detail with reference to the accompanying Figures. Like elements in the various figures may be denoted by like reference numerals for consistency. Further, in the following detailed description of embodiments of the present disclosure, numerous specific details are set forth in order to provide a more thorough understanding of the invention. However, it will be apparent to one of ordinary skill in the art that the embodiments disclosed herein may be practiced without these specific details. In other instances, well-known features have not been described in detail to avoid unnecessarily complicating the description.

Furthermore, those having ordinary skill in the art will appreciate that when describing connecting a first element to a second element, it is understood that connecting may be either directly connecting the first element to the second element, or indirectly connecting the first element to the second element. For example, a first element may be directly connected to a second element, such as by having the first element and the second element in direct contact with each other, or a first element may be indirectly connected to a second element, such as by having a third element, and/or additional elements, connected between the first and second elements.

Additionally, directional terms, such as "above," "below," "upper," "lower," "top," "bottom," etc., are used for convenience in referring to the accompanying drawings. In general, "above," "upper," "upward," "top," and similar terms refer to a direction toward the earth's surface from below the surface along a borehole, and "below," "lower," "downward," "bottom," and similar terms refer to a direction away from the surface along the borehole, i.e., into the borehole, but is meant for illustrative purposes only, and the terms are not meant to limit the disclosure.

In one aspect, embodiments disclosed herein generally relate to an apparatus, such as a wiper apparatus, that wipes a tubular member. The apparatus includes a first wiper section and a second wiper section, in which the first and second wiper sections are movable with respect to each other towards a point of convergence, such as towards the axis of a tubular member passing through the apparatus. The first wiper section and the second wiper section each may include a flexible material, such as by having a first flexible component within the first wiper section and a second flexible component within the second wiper section. The first flexible component of the first wiper section may be connected to a first rigid component, and the second flexible component of the second wiper section may be connected to a second rigid component. Dual wipers sections may also be used.

The apparatus may additionally include a base, such as by having the first wiper section and the second wiper section movable with respect to the base and removably connected to the base. Further, the apparatus may be disposed adjacent to a pipe handling apparatus, such as a spider assembly. An actuator may be connected between the first wiper section and/or the second wiper section and the base to move the first wiper section and the second wiper section with respect to each other, and the first wiper section and the second wiper section may be removably connected to the base using an attachment mechanism.

Figure 3A:
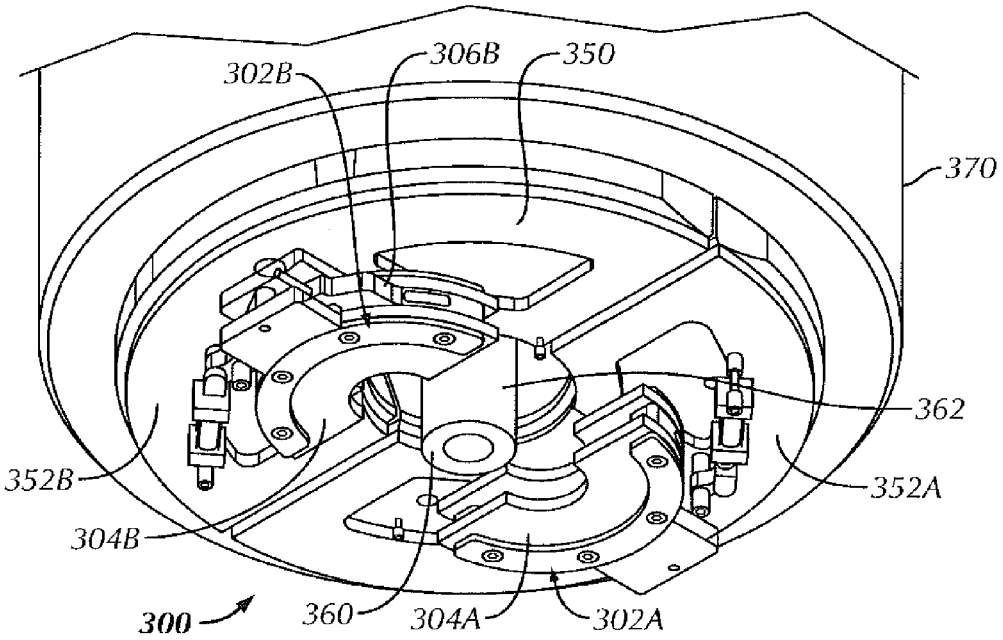
FIGS. 3A and 3B show perspective views of an apparatus to wipe a tubular member in accordance with one or more embodiments disclosed herein.
Figure 3B:
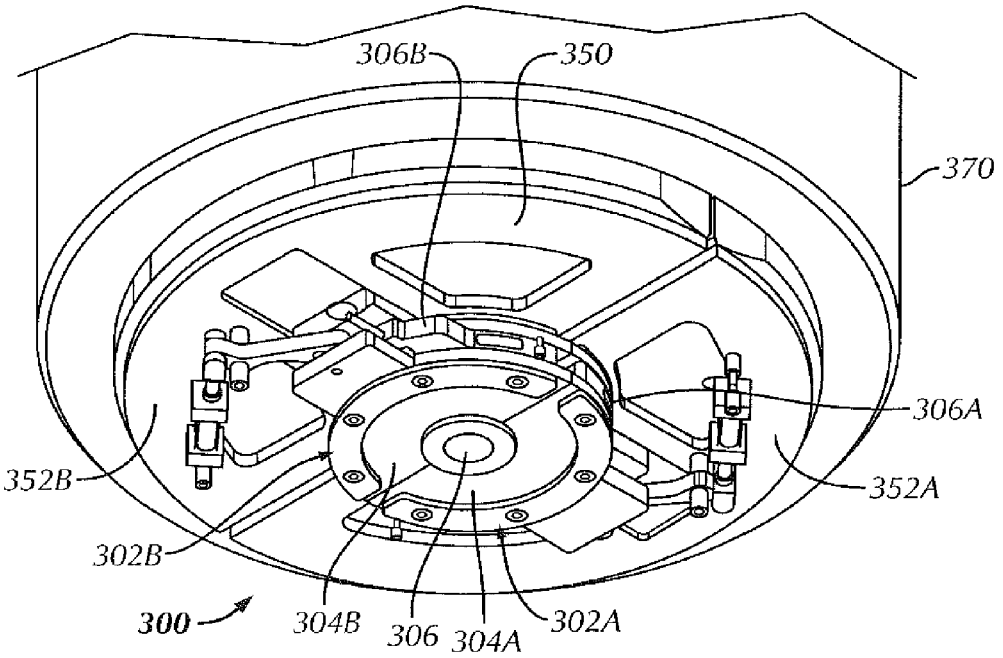

Referring now to FIGS. 3A and 3B, perspective views of an apparatus 300 to wipe a tubular member 360 in accordance with one or more embodiments disclosed herein are shown. FIG. 3A shows the apparatus 300 in an open position, and FIG. 3B shows the apparatus 300 in a closed position. In the open position, the apparatus 300 is positioned away from the tubular member 360 such that a gap is formed between the apparatus 300 and the tubular member 360. In the closed position, the apparatus 300 is positioned adjacent to the tubular member 360 such that the apparatus 300 may engage and wipe an outer surface 362 of the tubular member 360. As such, the apparatus 300 may be able to wipe an outer surface 362 of the tubular member 360 such as to remove fluid and/or debris (e.g., oil-based and/or water-based mud) from the outer surface 362 of the tubular member 360.

As shown in FIGS. 3A and 3B, the apparatus 300 includes a first wiper section 302A and a second wiper section 302B, in which the first and second wiper sections 302A and 302B may move with respect to each other. For example, the first and second wiper sections 302A and 302B may move with respect to each other between the open position and closed position towards a point of convergence, such as by moving with respect to each other towards an axis defined through the tubular member 360 and/or a pipe handling apparatus 370. Further, those having ordinary skill in the art will appreciate that more than two wiper sections may be used in accordance with embodiments disclosed herein, such as by having the apparatus formed of at least three wiper sections. In such an embodiment, the third wiper section may be movable with respect to the first wiper section and the second wiper section towards the same point of convergence as the first and second wiper sections.

The first wiper section 302A may include at least one flexible component 304A connected to a rigid component 306A, and the second wiper section 302B may include at least one flexible component 304B connected to a rigid component 306B. The flexible components may be formed from and/or include any flexible material known in the art, such as a rubber material and/or reinforced cloth material, that may be capable of engaging and wiping a surface of a tubular member. Further, as shown in FIGS. 3A and 3B, the first wiper section 302A may include two flexible components 304A, and the second wiper section 302B may include two flexible components 304B. However, those having ordinary skill in the art will appreciate that one or more flexible components may be included within either of the wiper sections, as the present disclosure contemplates embodiments including only one flexible component within a wiper section and also contemplates embodiments including at least three flexible components within a wiper section.

The first wiper section 302A and/or the second wiper section 302B of the apparatus 300 may be connected, such as removably connected, to a base 350, in which the base 350 may then be connected to the pipe handling apparatus 370. As shown in FIGS. 3A and 3B, the base 350 may include a first section 352A and a second section 352B. However, those having ordinary skill in the art will appreciate that the base may include more than two sections, or alternatively may include be formed of a single structure. In the embodiment shown in FIGS. 3A and 3B, the first wiper section 302A may be removably connected to the first section 352A of the base 350, and the second wiper section 302B may be removably connected to the second section 352B of the base 350.

Figure 4:
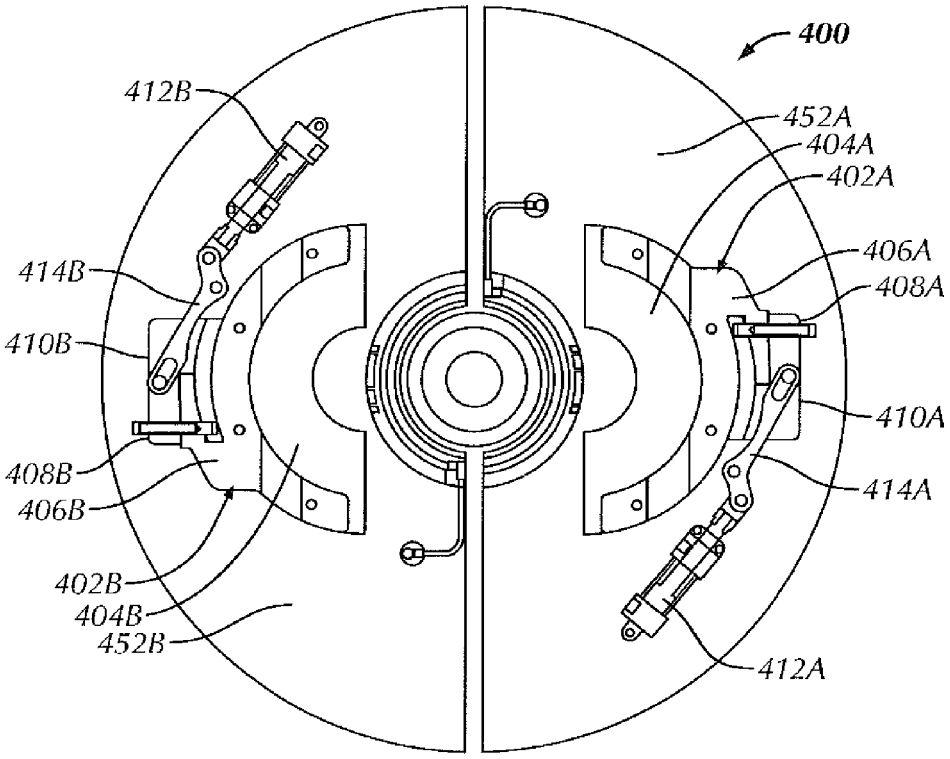
FIG. 4 shows a cross-sectional view of an apparatus to wipe a tubular member in accordance with one or more embodiments disclosed herein.

Accordingly, referring now to FIG. 4, a cross-sectional view of an apparatus 400 to wipe a tubular member 460 in accordance with one or more embodiments disclosed herein is shown. The apparatus 400 includes a first wiper section 402A and a second wiper section 402B connected to a base 450, in which the first wiper section 402A may be removably connected to a first section 452A of the base 450 and the second wiper section 402B may be removably connected to a second section 452B of the base 450.

As such, one or more attachment mechanisms 408A and 408B, such as a pin (as shown), a bolt, a screw, a clamp, a biasing device, or any other attachment mechanism known in the art, may be used to removably connect the first wiper section 402A and the second wiper section 402B to the base 450. Specifically, in the embodiment shown in FIG. 4, a rigid component 406A of the first wiper section 402A may be removably connected to a first translating block 410A through the first attachment mechanism 408A, and a rigid component 406B of the second wiper section 402B may be removably connected to a second translating block 410B through the second attachment mechanism 408B. The first wiper section 402A may include at least one flexible component 404A connected to the rigid component 406A, and the second wiper section 402B may include at least one flexible component 404B connected to the rigid component 406B. The flexible components may be formed from and/or include any flexible material known in the art, such as a rubber material and/or reinforced cloth material, that may be capable of engaging and wiping a surface of a tubular member. Those having ordinary skill in the art will appreciate that one or more flexible components may be included within either of the wiper sections, as the present disclosure contemplates embodiments including only one flexible component within a wiper section and also contemplates embodiments including at least three flexible components within a wiper section.

Further, the apparatus may include one or more actuators to move the apparatus between an open position and a closed position. As such, in FIG. 4, the apparatus 400 may include a first actuator 412A and a second actuator 412B, each connected to the base 450. The first actuator 412A may be connected to the translating block 410A through a first coupler link 414A, and the second actuator 412B may be connected to the second translating block 410B through a second coupler link 414B. As the actuators 412A and 412B actuate, the first actuator 412A may move the first wiper section 402A between the open and closed positions through the first coupler link 414A and the first translating block 410A, and the second actuator 412B may move the second wiper section 402B between the open and closed positions through the second coupler link 414B and the second translating block 410B.

The actuators may be hydraulic, pneumatic, electric, and/or any other type of actuator known in the art. Further, the present disclosure contemplates that other arrangements and configurations may be used to move the apparatus between the open and closed positions. For example, rather than having two actuators to move the first and second wiper sections between the open and closed positions, a single actuator may be arranged and connected between the first and second wiper sections and the base, such as with multiple coupler links, to control the movement of the first and second wiper sections. Accordingly, other arrangements and configurations may be used to move the apparatus between the open and closed positions.

Furthermore, the apparatus may include one or more position sensors to detect the position of the apparatus. For example, a first position sensor may be coupled to the first actuator 412A, thereby enabling the first position sensor to detect the position of the first wiper section 402A within the apparatus 400, and a second position sensor may be coupled to the second actuator 412B, thereby enabling the second position sensor to detect the position of the second wiper section 402B within the apparatus 400.

Figure 5:
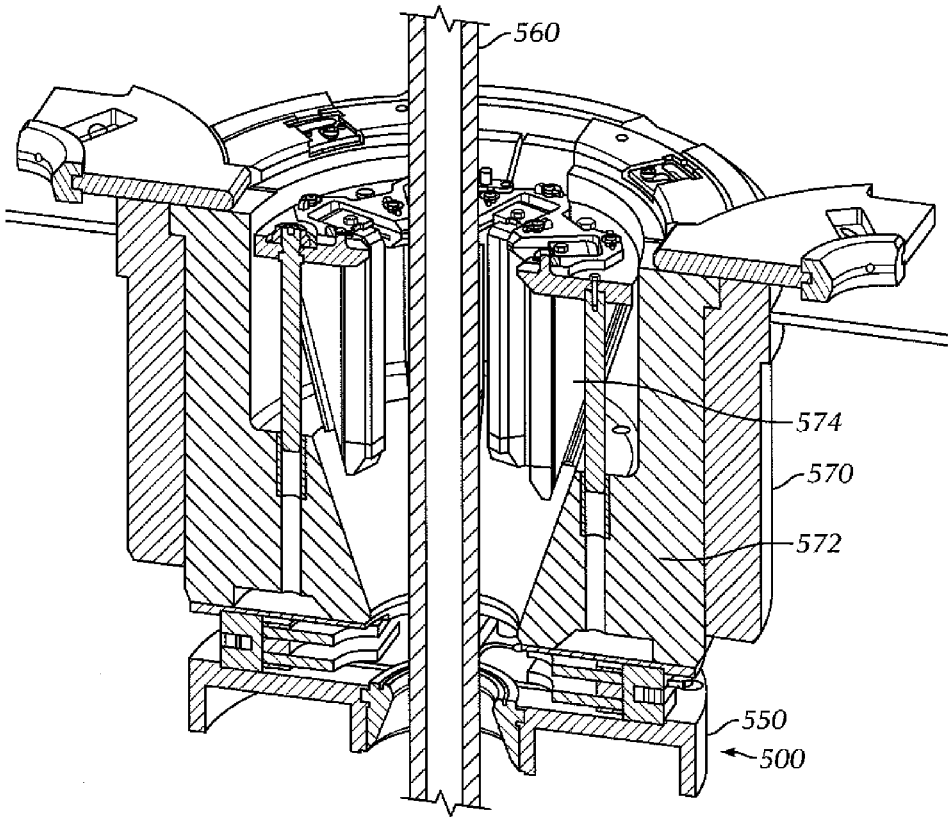
FIG. 5 shows a perspective sectional view of an apparatus connected to a pipe handling apparatus in accordance with one or more embodiments disclosed herein.

Referring now to FIG. 5, a perspective sectional view of an apparatus 500 connected to a pipe handling apparatus 570 in accordance with one or more embodiments disclosed herein are shown. The apparatus 500 may be connected to the pipe handling apparatus 570, such as by having the base 550 of the apparatus 500 connected to the pipe handling apparatus 570. In one or more embodiments, the base 550 may be removably connected to the pipe handling apparatus 570, such that the apparatus 500 may be movable between multiple pipe handling apparatuses.

In the embodiment shown in FIG. 5, the pipe handling apparatus 570 may include a spider, in which the pipe handling apparatus 570 may include a bowl 572 with one or more slip assemblies 574 movably connected to the bowl 572. The slip assemblies 574 may move within the pipe handling apparatus 570 between an open position and a closed position to handle and grip the tubular member 560. As such, the apparatus 500 is movable between the open and closed positions to engage and wipe the tubular member 560 as the tubular member passes through the pipe handing apparatus 570.

Figure 6:
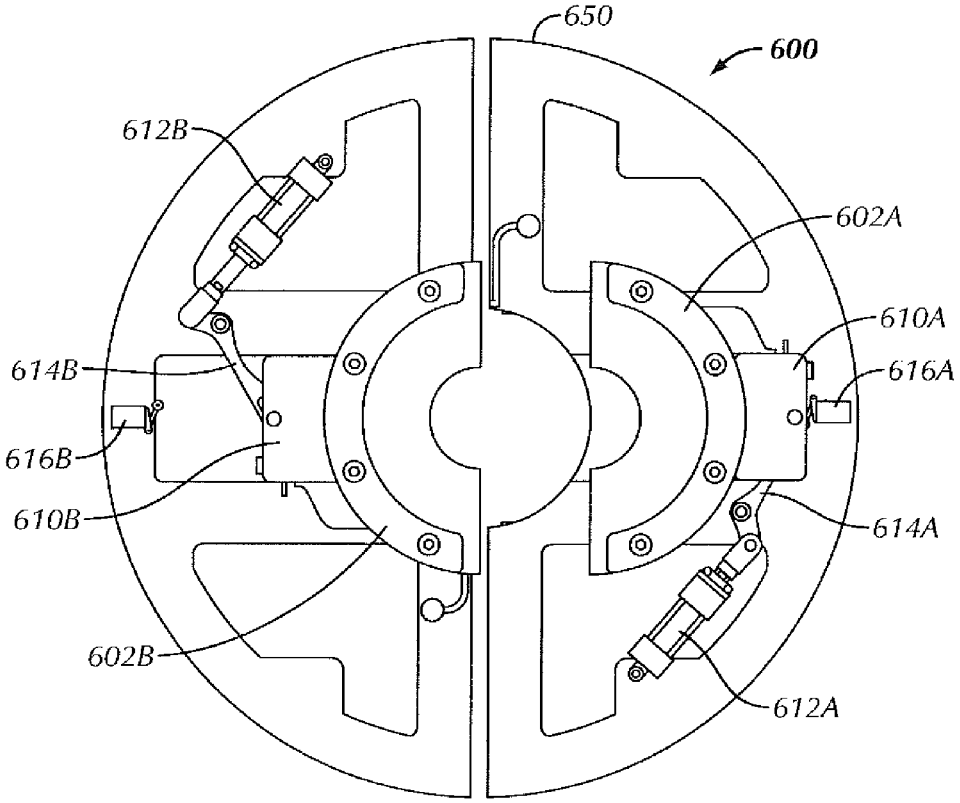
FIG. 6 shows a cross-sectional view of an apparatus to wipe a tubular member in accordance with one or more embodiments disclosed herein.

Referring now to FIG. 6, a cross-sectional view of an apparatus 600 to wipe a tubular member in accordance with one or more embodiments disclosed herein is shown. The apparatus 600 includes a first wiper section 602A and a second wiper section 602B connected to a base 650, in which the first wiper section 602A may be removably connected to the first translating block 610A, and the second wiper section 602B may be removably connected to the second translating block 610B. Further, the first actuator 612A may be connected to the first translating block 610A through the first coupler link 614A, and the second actuator 612B may be connected to the second translating block 610B through the second coupler link 614B. As the actuators 612A and 612B actuate, the first actuator 612A may move the first wiper section 602A between the open and closed positions through the first coupler link 614A and the first translating block 610A, and the second actuator 612B may move the second wiper section 602B between the open and closed positions through the second coupler link 614B and the second translating block 610B.

Further, as discussed above, the apparatus 600 may include one or more position sensors 616 to detect the position of the apparatus. For example, a first position sensor 616A may be coupled to the first wiper section 602A, thereby enabling the first position sensor 616A to detect the position of the first wiper section 602A. Specifically, as shown in FIG. 6, the first position sensor 616A may engage with the first translating block 610A and/or the first coupler link 614A when the first wiper section 602A is in the open position, thereby enabling the first position sensor 616A to indicate that the first wiper section 602A is in the open position.

Similarly, a second position sensor 616B may be coupled to the second wiper section 602B, thereby enabling the second position sensor 616B to detect the position of the second wiper section 602B. As such, and as shown in FIG. 6, the second position sensor 616B may engage with the second translating block 610A and/or the second coupler link 614B when the second wiper section 602B is in the open position, thereby enabling the second position sensor 616B to indicate that the second wiper section 602B is in the open position.

Further, in one aspect, embodiments disclosed herein relate to a system, an apparatus, and/or a method to sense wear within a pipe guide and/or within a pipe handling apparatus. The apparatus includes a pipe guide that has a wear sensor coupled thereto. The pipe guide may be disposed adjacent to an opening of a pipe handling apparatus, in which the pipe guide with the wear sensor may be disposed adjacent to an opening of the pipe handling apparatus. The wear sensor may be any sensor known in the art, such as a mechanical sensor, a pneumatic sensor, a hydraulic sensor, and/or an electrical sensor. However, as shown below, the wear sensor may be a pneumatic sensor, in which the sensor may include flexible tubing having pressurized gas therein. As such, the wear sensor may be disposed within a groove of the pipe guide, in which wear sensor may indicate that a predetermined level of wear has been reached within the pipe guide when the wear sensor has been punctured and has loss of pressure for the pressurized gas.

Figure 7:
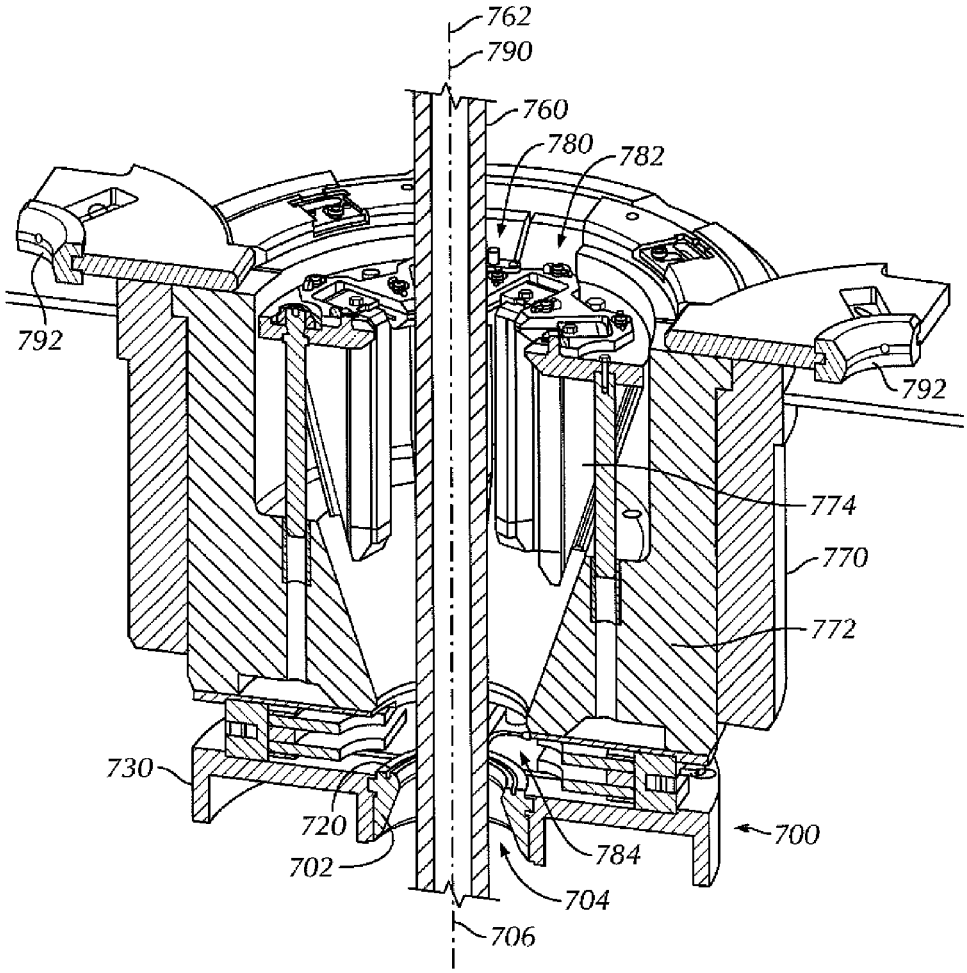
FIG. 7 shows a perspective sectional view of an apparatus connected to a pipe handling apparatus in accordance with one or more embodiments disclosed herein.

Referring now to FIG. 7, a perspective sectional view of an apparatus 700 connected to a pipe handling apparatus 770 in accordance with one or more embodiments disclosed herein is shown. In this embodiment, the pipe handling apparatus 770 may be a spider, in which the pipe handling apparatus 770 may include a bowl 772 with one or more slip assemblies 774 movably connected to the bowl 772. The slip assemblies 774 may move within the pipe handling apparatus 770 between an open position and a closed position to handle and grip a tubular member 760.

Accordingly, the pipe handling apparatus 770 may include a bore 780 formed therein about an axis 790, in which the bore 780 defines a first opening 782 (e.g., a top opening) and a second opening 784 (e.g., a bottom opening) for the pipe handling apparatus 770. As such, the axis 790 for the pipe handling apparatus 770 may substantially align with an axis 762 for the tubular member 760, such as when the slip assemblies 774 are in the closed position to handle and grip the tubular member 760. Those having ordinary skill in the art, however, will appreciate that the present disclosure contemplates that other pipe handling apparatuses may be used besides a spider, such as an elevator, without departing from the present disclosure. Further, in one or more embodiments, a pipe handling apparatus in accordance with the present disclosure may be disposed and/or recessed within a floor of a drilling rig and/or within a rotary.

Referring still to FIG. 7, the apparatus 700 includes a pipe guide 702 disposed adjacent to the pipe handling apparatus 770. Specifically, in this embodiment, the pipe guide 702 may be disposed adjacent to the second opening 784 of the pipe handling apparatus 700. As shown, the pipe guide 702 may have a bore 704 formed therein about an axis 706, in which the axis 706 for the pipe guide 702 may substantially align with the axis 790 for the pipe handling apparatus 770. The pipe guide 702 may be formed from any material known in the art, such as wearable material, including any metal or metal alloy known in the art. As such, the pipe guide 702 may be used to guide the tubular member 760 into the pipe handling apparatus 770, such as when the tubular member 760 is entering and/or exiting through the second opening 784 of the pipe handling apparatus 770.

Further, an additional, second pipe guide 792 may be disposed adjacent to the first opening 782 of the pipe handling apparatus 770. The second pipe guide 792 may be movable between an open position, as shown in FIG. 7, and a closed position. As such, in the closed position, the pipe guide 792 may be used to guide the tubular member 760 into the pipe handling apparatus 770, such as when the tubular member 760 is entering and/or exiting through the first opening 782 of the pipe handling apparatus 770.

As the pipe guide 702 is formed from a wearable material, the pipe guide 702 may include a wear sensor 720 coupled thereto. A wear sensor in accordance with the present disclosure may be used to measure an amount of wear that has occurred within a pipe guide, such as particularly indicating when a predetermined amount of wear for the pipe guide has been reached. As such, and as shown in FIG. 7, the wear sensor 720 may be used to sense and indicate when a predetermined amount of wear has been reached for the pipe guide 702, in which the pipe guide 702 may then need to be refurbished and/or replaced.

Referring still to FIG. 7, to have the pipe guide 702 disposed adjacent to the pipe handling apparatus 770, the pipe guide 702 may be connected to a base 730, in which the base 730 may then be connected to the pipe handling apparatus 770. The pipe guide 702 may also be removably connected to the base 730, as the pipe guide 702 may be need to be replaced, as desired, or at intervals indicated by the wear sensor 720.

Figure 8A:
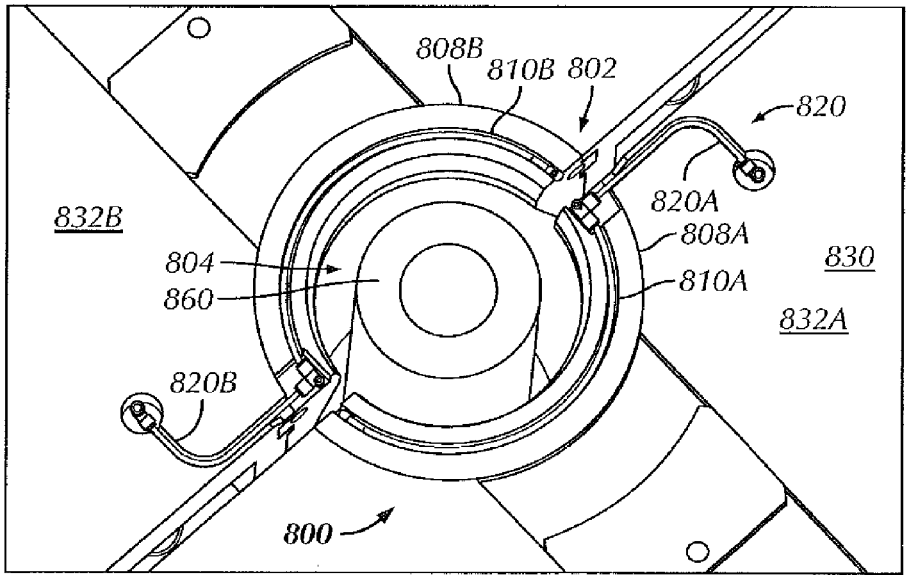
FIGS. 8A and 8B show multiple views of an apparatus in accordance with one or more embodiments disclosed herein.
Figure 8B:
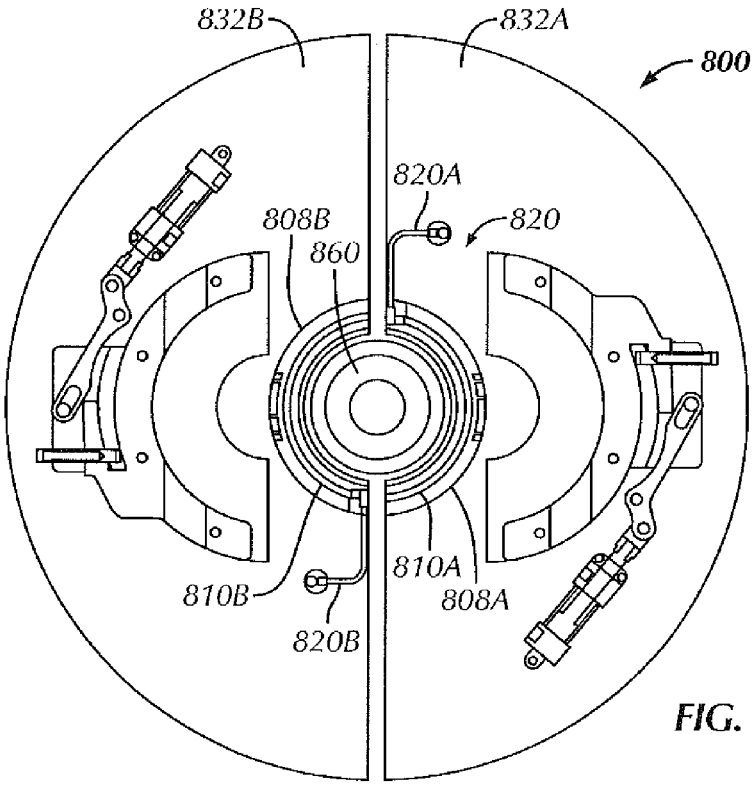

Referring now to FIGS. 8A and 8B, multiple views of an apparatus 800 in accordance with one or more embodiments disclosed herein are shown. FIG. 8A provides a perspective detailed view of the apparatus 800, and FIG. 8B provides a top down view of the apparatus 800. As discussed above, the apparatus 800 includes a pipe guide 802 connected to a base 830. As such, in this embodiment, the pipe guide 802 may include a first pipe guide section 808A and a second pipe guide section 808B. The first pipe guide section 808A and the second pipe guide section 808B may be used to guide the tubular member 860 into a pipe handling apparatus. Those having ordinary skill in the art will appreciate that more than two sections may be used in accordance with embodiments disclosed herein, such as by having the apparatus formed of at least three sections.

The first pipe guide section 808A and/or the second pipe guide section 808B may be connected, such as removably connected, to the base 830, in which the base 830 may then be connected to a pipe handling apparatus. As shown in FIGS. 8A and 8B, the base 830 may include a first base section 832A and a second base section 832B. However, those having ordinary skill in the art will appreciate that the base may include more than two sections, or alternatively may be formed of a single structure. In the embodiment shown in FIGS. 8A and 8B, the first pipe guide section 808A may be removably connected to the first base section 832A, and the second pipe guide section 808B may be removably connected to the second base section 832B.

As mentioned above, the pipe guide 802 includes a wear sensor 820 coupled thereto, in which the wear sensor 820 may be used to sense wear in the pipe guide 802. As such, in this embodiment, as the pipe guide 802 may include the first pipe guide section 808A and the second pipe guide section 808B, a first wear sensor 820A may be coupled to the first pipe guide section 808A, and a second wear sensor 820B may be coupled to the second pipe guide section 808B.

As shown in FIGS. 8A and 8B, the first pipe guide section 808A may have a groove 810A formed therein, in which the first wear sensor 820A may be disposed, at least partially, within the groove 810A. As such, in selected embodiments, the first wear sensor 820A may comprise flexible tubing containing a pressurized gas therein and configured to fit within the groove 810A of the first pipe guide section 808A. Similarly, the second pipe guide section 808B may have a groove 810B formed therein, in which the second wear sensor 820B may be disposed, at least partially, within the groove 810B. As such, the second wear sensor 820B may comprise flexible tubing containing a pressurized gas therein and configured to fit within the groove 810B of the first pipe guide section 808B.

Accordingly, as the pipe guide 802 wears from guiding tubular members 860 into a pipe handling apparatus, the wear may eventually erode the first pipe guide section 808A from the bore 804 towards the groove 810A and/or erode the second pipe guide section 808B from the bore 804 towards the groove 810B. Once the pipe guide sections 808A and 808B erode to the grooves 810A and 810B, the tubular member 860 may then be in direct contact with the first wear sensor 820A and/or the second wear sensor 820B.

As the tubular member 860 contacts the wear sensors 820A and/or 820B, the tubular member 860 may wear the wear sensors 820A and/or 820B such that the flexible tubing may rupture. As the flexible tubing may have pressurized gas therein, the pressure of the gas within the wear sensors 820A and/or 820B may be monitored, such as having the wear sensors 820A and/or 820B coupled to a control panel, to determine that the flexible tubing has ruptured and pressurized gas is leaking therefrom, and therefore the pipe guide 802 may need replacing. Specifically, in the embodiment shown in FIGS. 8A and 8B, the first wear sensor 820A may be used to indicate that the first pipe guide section 808A needs to be replaced, and the second wear sensor 820B may be used to indicate that the second pipe guide section 808B needs to be replaced.

As shown and discussed above, the wear sensor may be a pneumatic sensor, such that the gas pressure in the sensor is monitored to determine and sense the wear that has occurred within the pipe guide. However, those having ordinary skill in the art will appreciate that the wear sensor may be any sensor known in the art, such as a mechanical sensor, a magnetic sensor, a different pneumatic sensor, a hydraulic sensor, and/or an electrical sensor.

For example, in one embodiment, an electrical sensor may be disposed and/or included within the pipe guide, in which the electrical wear sensor may similarly indicate when a tubular member has made contact with the electrical wear sensor. In such an embodiment, the electrical wear sensor may be monitored, and when the wear sensor contacts the tubular member, such as if an electrical current passes from the electrical wear sensor to the tubular member, the wear sensor may indicate that the pipe guide needs to be replaced. As such, the present disclosure contemplates other arrangement and configurations for a wear sensor to measure and/or otherwise indicate that a predetermined amount of wear has occurred within the pipe guide.

Those having ordinary skill in the art will appreciate that FIGS. 8A and 8B show the apparatus 800 including two pipe guide sections 808A and 808B, two base sections 832A and 832B, and two wear sensors 820A and 820B, those having ordinary skill in the art that the present disclosure is not so limited. Specifically, an apparatus in accordance with the present disclosure may include one or more pipe guide sections, one or more base sections, and/or one or more wear sensors, independent of how many sections are included for other components of the apparatus. For example, though an apparatus in accordance with the present disclosure may include three pipe guide sections, the apparatus may only need to include one wear sensor. Accordingly, the present disclosure contemplates other configurations and arrangements for an apparatus to sense wear that may not be shown in FIGS. 7, 8A, and 8B.

Furthermore, in one aspect, embodiments disclosed herein generally relate to a system and apparatus to at least partially clean a tubular member. The system includes an apparatus to support a tubular member having a bore with a longitudinal axis extending therethrough. The apparatus further includes a first opening formed on a first side thereof and a second opening formed on a second side thereof, and a fluid dispensing system is disposed adjacent to the second opening of the apparatus. The fluid dispensing system has a nozzle to dispense fluid therefrom, such as to clean an outer diameter of a tubular member supported within the apparatus. As such, the fluid may include liquid and/or gas, such as by having the nozzle dispense a water-based liquid, oil-based liquid, air, and/or any other fluid therefrom.

The apparatus to support the tubular member may include a spider and/or a collar load support system, each discussed above. As such, the apparatus may include a bowl having a tapered inner wall, and a plurality of slip assemblies movably disposed within the bowl. Further, embodiments disclosed herein may include a fluid inlet to receive fluid therein, and a fluid passage to direct fluid from the fluid inlet to the nozzle of the fluid dispensing system. A valve may also be included, such as within the fluid passage, to control fluid flow therethrough. A fluid receiving system may also be used in conjunction with the fluid dispensing system, such as by having the fluid receiving system disposed adjacent to the fluid dispensing system. The fluid receiving system may then include an inlet to receive fluid therein, and may further include a suction pump such as to facilitate receiving fluid from the fluid dispensing system into the fluid receiving system.

Figure 9A:
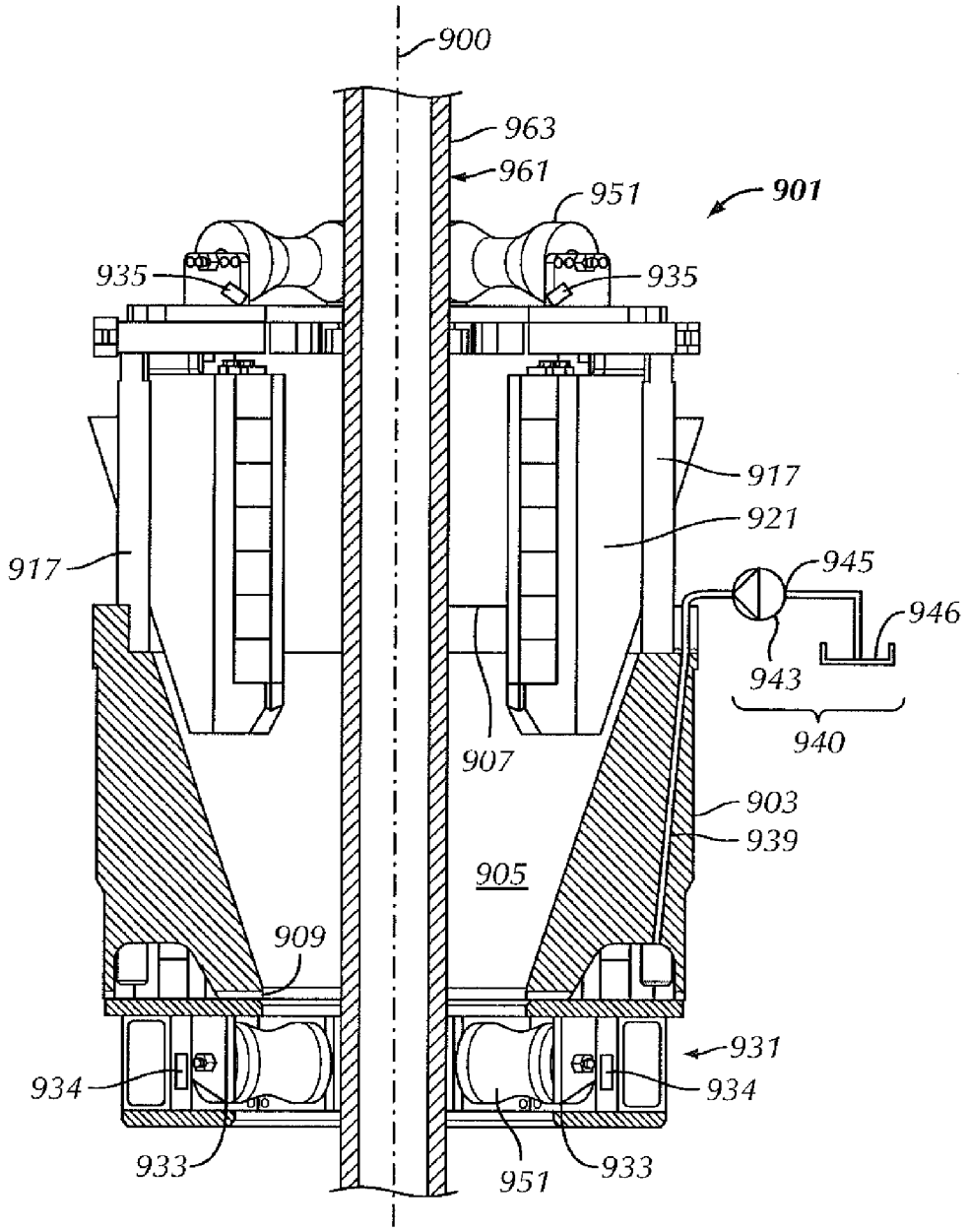
FIGS. 9A and 9B show cross-sectional views of an apparatus to clean a tubular member in accordance with one or more embodiments disclosed herein.
Figure 9B:
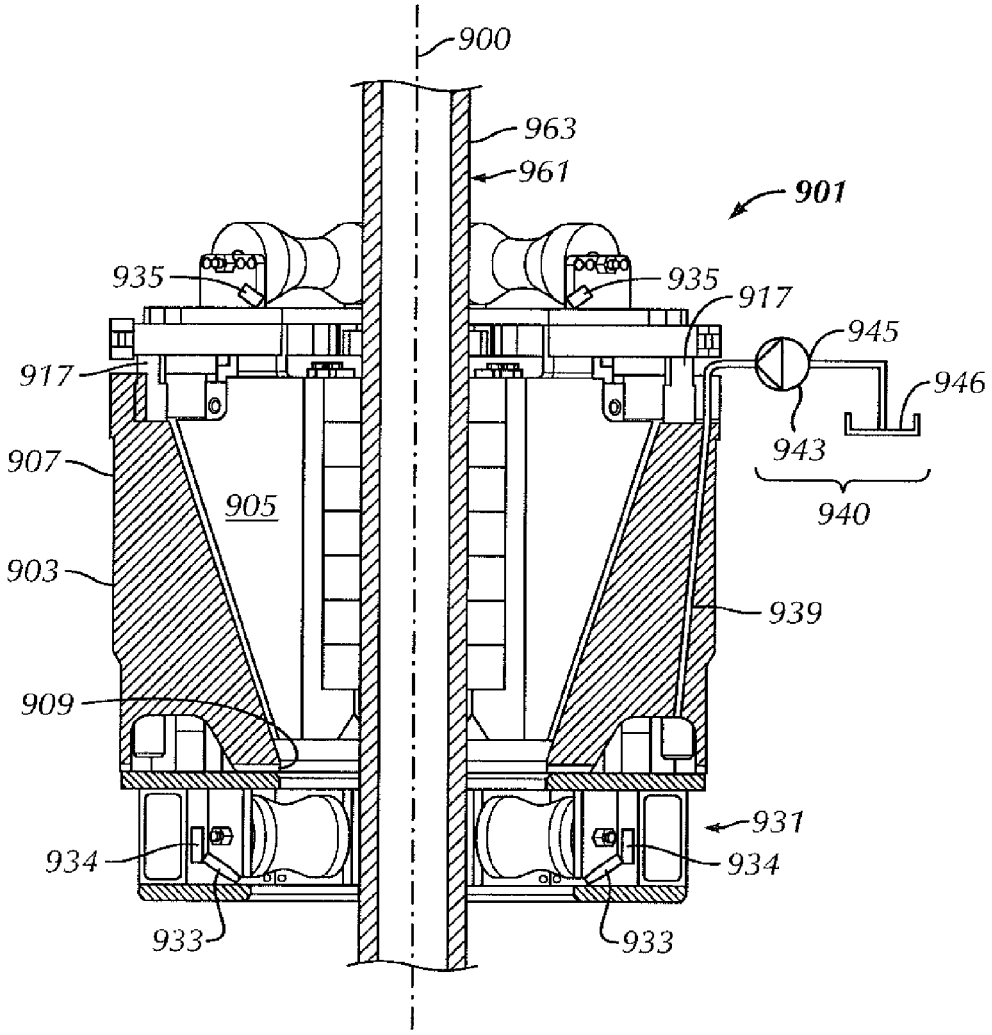

Referring now to FIGS. 9A and 9B, cross-sectional views of an apparatus 901 to support and clean a tubular member in accordance with one or more embodiments disclosed herein are shown. FIG. 9A shows the apparatus 901 in the open position, and FIG. 9B shows the apparatus 901 in the closed position. In the open position, the apparatus 901 is positioned away from a tubular member 961 such that a gap is formed between the apparatus 901 and the tubular member 961. In the closed position, the apparatus 901 is positioned adjacent to the tubular member 961 such that the apparatus 901 may engage and support an outer surface 963 of the tubular member 961. As such, the apparatus 901 may be used to clean, at least partially, an outer surface 963 of the tubular member 961, such as to remove fluid and/or debris (e.g., oil-based and/or water-based mud) from the outer surface 963 of the tubular member 961.

The apparatus 901, which may include a spider, as illustrated, a collar load support system, an elevator (such as with the attachment of lifting bail or link eyes), or other similar device, may be used to handle and support the tubular member 961. As such, in one or more embodiments, the apparatus 901 may include a bowl 903 defining a bore 905 therein. The bore 905 may be formed about an axis 900 extending longitudinally through the apparatus 901. Specifically, the bowl 903 may be formed such that a top opening 907 of the bore 905 is formed at a top side of the bowl 903, and a bottom opening 909 of the bore 905 is formed at the bottom side of the bowl 903. Further, the bowl 903 has an inner wall that extends between the top opening 907 of the bowl 903 to the bottom opening 909. Although the bowl is shown as being a continuous surface, the term bowl may also refer to a plurality of discrete surfaces without departing from the scope of the present disclosure. The inner wall of the bowl 903 is skewed at an angle (e.g., tapered) with respect to the axis 900. For example, the bowl 903 may have a smooth, non-stepped profile, tapered inner wall, in which the bowl 903 may be used to enable the apparatus 901 to grip a range of tubular members having different dimensions (e.g., different outer diameters), with the slip assemblies moving along the bowl 903. However, those having ordinary skill in the art will appreciate that the present disclosure is not so limited, as other shapes and profiles, such as a stepped (e.g., "rapid advance") profile, may be used for the inner wall of the bowl without departing from the scope of the present disclosure.

The apparatus 901 may further include a plurality of slip assemblies 921, in which the slip assemblies 921 are movable with respect to the bowl 903 (e.g., in-and-out of the bowl 903), such as by having the slip assemblies 921 movably connected to the bowl 903. Specifically, the slip assemblies 921 are movable in a radial direction with respect to the axis 900 as well as being movable in a longitudinal direction along the axis 900. For example, by having the slip assemblies 921 movably connected to the bowl 903, the slip assemblies 921 may be able to "slide" towards and/or away from the axis 900, e.g., move along the inner wall of the bowl 903. As such, the slip assemblies 921 may be used to grip a tubular member, such as gripping an outer surface of a tubular member received within the apparatus 901.

Referring still to FIGS. 9A and 9B, the apparatus 901 may further include a fluid dispensing system 931 used therewith, such as to clean the outer surface 963 of the tubular member 961. The fluid dispensing system 931, which in selected embodiments includes one or more nozzles 933, may be used to dispense fluid therefrom, such as pressurized fluid, towards the tubular member 961, thereby removing mud, debris, and/or any other fluids or particulate that may accumulate on the outer surface 963 of the tubular member 961. As such, in accordance with one or more embodiments of the present disclosure, the fluid dispensing system 931 may be used to dispense any fluid therefrom, such as dispense gas and/or liquids therefrom, to clean the tubular member 961. The gas used in the fluid dispensing system 931 may be any gas known in the art, such as pressurized air, and similarly the liquid used in the fluid dispensing system 931 may be any liquid known in the art, such as a water-based liquid and/or an oil-based liquid. Particularly, in at least one embodiment, a liquid including deep clean additives to facilitate cleaning of one or more tubular members may be used. Accordingly, when the nozzles 933 dispense fluid therefrom, the fluid may be pressurized. For example, in one embodiment in which the nozzles 933 dispense liquid therefrom, the nozzles 933 may be capable of having the liquid flow at a pressure of about 2000 psi (13800 kPa), and flow at a rate of about 21 gallons per minute (79 liter per minute) out of the fluid dispensing system 931.

The fluid dispensing system 931 may be disposed adjacent to one side of the apparatus 901, such as by disposing the fluid dispensing system 931 adjacent to the bottom opening 909 of the bore 905 of the apparatus 901. By having the fluid dispensing system 931 disposed adjacent to the bottom opening 909 of the apparatus 901, the fluid dispensing system 931 may be used to clean the outer surface 963 of the tubular member 961 when received through the bottom opening 909 of the apparatus 901. As such, this may remove and prevent mud, debris, and/or any other fluids or particulate from accumulating within the apparatus, such as when receiving a string of tubular members into the apparatus when removing the string from downhole.

As mentioned above, the fluid dispensing system 931 may include one or more nozzles 933 to dispense fluid therefrom. As such, the fluid dispensing system 931 may include a plurality of nozzles 933, such as by having the nozzles 933 arranged about the axis 900. For example, in one embodiment, the nozzles 933 may be substantially equally spaced from each other when arranged and disposed about the axis 900. Further, the number of nozzles 933 included within the fluid dispensing system 931 may depend upon the size of the tubular members used with the apparatus 901. For example, in an embodiment in which the apparatus 901 is used to handle and support tubular members having an outer diameter of 15.5 in (39.4 cm), the fluid dispensing system 931 may include about ten nozzles. However, those having ordinary skill in the art will appreciate that the present disclosure is not so limited, as the present disclosure contemplates other numbers, arrangements, and configurations for the nozzles of the fluid dispensing system.

The one or more nozzles 933 of the fluid dispensing system 931 may be movable, such as by having the nozzles 933 movably connected to the apparatus 901. The nozzles 933 may be movable such as to have the nozzles 933 selectively divert and/or dispense fluid therefrom in a desired pattern and/or direction. For example, the nozzles 933 of the fluid dispensing system 931 may be rotatable, such as to have the nozzles 933 adjust in rotational orientation to selectively clean tubular members received within the apparatus 901. Additionally, or alternatively, the nozzles 933 may be able to move about, along, or otherwise with respect to the axis 900 of the apparatus 901, such as by having the nozzles 933 rotate about the axis 900, move in a radial direction with respect to the axis 900, and/or move in a longitudinal direction with respect to the axis 900. Accordingly, the present disclosure contemplates having one or more degrees-of-freedom for the movement of the nozzles of the fluid dispensing system.

Further, the present disclosure contemplates moving one or more nozzles using multiple methods and procedures, such as by having the valves hand-controlled, pedestal-controlled, remotely controlled, in addition to being controlled to coordinate with the movement of the apparatus 901. Furthermore, one or more actuators may be coupled to the one or more nozzles to impart movement thereto, as desired. An actuator may be mounted to a nozzle and/or other components of the fluid dispensing system via linkage or other ways known in the art. One or more nozzles thus may include and/or have an actuator attached thereto, such as to move the nozzles towards, away, about, and/or along the bore of the apparatus. As such, an actuator may have a sensor and/or a controller coupled thereto and/or with each other, in which a sensor may be able to communicate the position of a nozzle and the controller may be able to send signals to control the actuator, thereby enabling the actuator to move the nozzles to a desired position or orientation.

For example, referring to FIGS. 9A and 9B, an actuator 934 may be mounted to a nozzle 933 and/or other components of the fluid dispensing system 931 via linkage or other ways known in the art. One or more nozzles 933 thus may include and/or have an actuator 934 attached thereto, such as to move the nozzles 931 towards, away, about, and/or along the bore of the apparatus. As such, an actuator 934 may have a sensor and/or a controller coupled thereto and/or with each other, in which a sensor may be able to communicate the position of a nozzle 933 and the controller may be able to send signals to control the actuator 934, thereby enabling the actuator 934 to move the nozzles 933 to a desired position or orientation.

An actuator used in accordance with one or more embodiments disclosed herein may be a hydraulic, pneumatic, electric, and/or any other actuator known in the art. An actuator may be remotely controlled. For example, in one embodiment, nozzles having actuators connected thereto may be controlled, such as controlled by a processor or other control system, to dispose one or more of the actuated nozzles to a desired location. Further, those having ordinary skill in the art will appreciate that other arrangements for an actuator to move one or more nozzles in accordance with embodiments disclosed herein may be used without departing from the scope of the present disclosure.

For example, referring to FIGS. 9A and 9B, slip assemblies may be connected to a ring, in which the ring may be connected to the bowl 903 through an actuator (e.g., actuator rods) 917. Actuator 917 may be actuated, such as electrically actuated and/or fluidly (e.g., hydraulically) actuated, to move up and/or down with respect to the bowl 903, in which the slip assemblies connected to the ring may correspondingly move up and/or down with respect to the bowl 903. Further, as shown, in one or more embodiments, nozzles 935 may be disposed above the actuator 917 and above the bowl 903 such that actuation of the actuator 917 may displace the nozzles 935 relative to the bowl 903.

In accordance with one or more embodiments disclosed herein, a fluid inlet and a fluid passage may be used to incorporate the fluid dispensing system with the apparatus to support a tubular member. When used with a spider, as shown in FIGS. 9A and 9B, the fluid dispensing system 931 may include or have coupled thereto a fluid inlet to receive fluid therein and a fluid passage to direct fluid from the fluid inlet to the one or more nozzles 933 of the fluid dispensing system 931. In such an embodiment, the fluid inlet may be disposed adjacent to one of the openings 905 and 907 of the bore 903 of the apparatus 901.

For example, the fluid inlet may be formed or disposed adjacent to the top opening 907 of the bore 903, in which a fluid passage may then extend from the fluid inlet to the fluid dispensing system 931 to provide fluid to the nozzles 933 of the fluid dispensing system 931. The fluid passage may include a hose, piping, and/or any other type of conduit or structure that is external to the apparatus 901 to provide fluid from the fluid inlet to the fluid dispensing system 931. Alternatively, the fluid passage may be formed internally within the apparatus 901, such as by having the fluid passage formed within the bowl 903 of the apparatus 901. In such an embodiment, the fluid passage may, at least partially, be formed within and extend through the bowl 903 of the apparatus 901 to provide fluid received from a fluid inlet, such as disposed adjacent to the top opening 905 of the apparatus 901, to the fluid dispensing system 931 disposed adjacent to the bottom opening 907 of the apparatus 901.

For example, referring to FIGS. 9A and 9B, a fluid passage 939 may, at least partially, be formed within and extend through the bowl 903 of the apparatus 901 to provide fluid received from a fluid inlet, such as disposed adjacent to the top opening 907 of the apparatus 901, to the fluid dispensing system 931 disposed adjacent to the bottom opening 909 of the apparatus 901.

Further, one or more valves may be used with and/or incorporated into a fluid dispensing system to selectively control fluid flow thereto in accordance with the present disclosure. For example, in an embodiment having a fluid inlet and a fluid passage, the fluid passage may include a valve, such as connected thereto or disposed therein, to selectively control fluid flow through the fluid passage. If the fluid passage is formed within the apparatus 901, the valve may be disposed within the fluid passage, such as disposed within the apparatus 901. Additionally, or alternatively, the valve may be disposed adjacent to the apparatus 901 and/or fluid dispensing system 931, such as connected to the fluid passage extending before the fluid inlet and/or connected to the fluid passage extending between the fluid inlet and the fluid dispensing system 931.

A valve in accordance with the present disclosure may be used to selectively control fluid flow to the nozzles 933 of the fluid dispensing system 931, such as by controlling the pressure of the fluid provided to the fluid dispensing system 931, and/or controlling the activation of the nozzles 933 of the fluid dispensing system 931 altogether. As such, the present disclosure contemplates controlling one or more valves using multiple methods and procedures, such as by having the valves hand-controlled, pedestal-controlled, remotely controlled, in addition to being controlled to coordinate with the movement of the apparatus 901. For example, valves may be used to enable the fluid dispensing system 931 to activate only when desired, such as only when a tubular member is disposed within the apparatus 901.

Accordingly, in one embodiment, one or more valves may be used to control, activate, and dispense fluid from the fluid dispensing system 931 when the apparatus 901 is in the open position, as shown in FIG. 9A. Alternatively, the fluid dispensing system may be controlled, such as by using valves, to enable the fluid to be dispensed therefrom depending on the arrangement of other devices used in conjunction with the apparatus supporting the tubular members. For example, the fluid dispensing system may be controlled to dispense fluid therefrom only when other devices, such as an elevator or top drive, are engaged with the tubular members to provide support thereto, or may be controlled to coordinate with an interlock system or the movement of the plurality of slip assemblies. As such, the present disclosure contemplates multiple configurations and methods for arranging and controlling a fluid dispensing system in accordance with the present disclosure.

Figure 13:
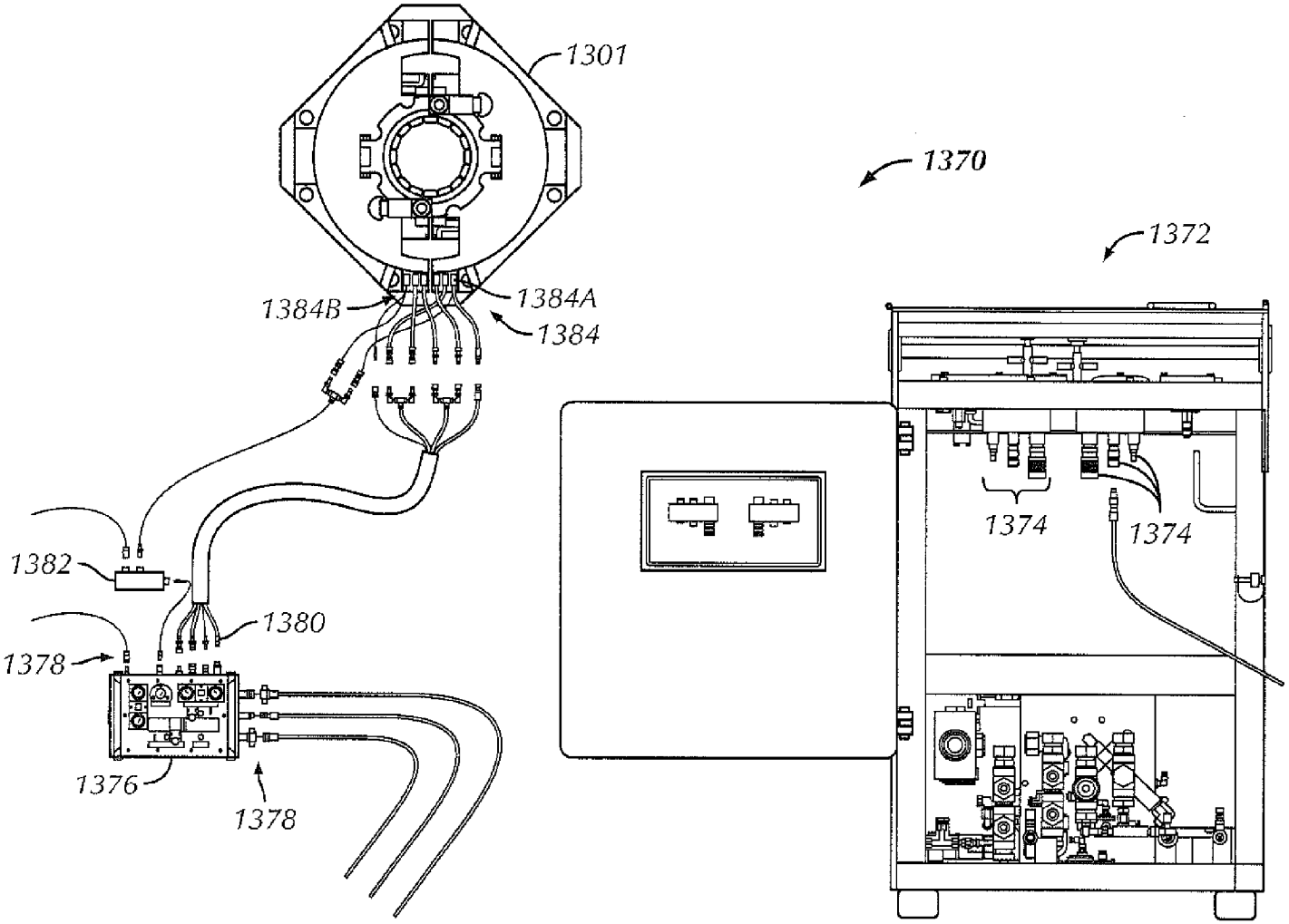
FIG. 13 shows a perspective view of a system having an apparatus to clean a tubular member in accordance with one or more embodiments disclosed herein.

Accordingly, with reference to FIG. 13, a system 1370 to control an apparatus 1301 having a fluid dispensing system to support and clean a tubular member in accordance with one or more embodiments of the present disclosure is shown. The apparatus 1301, which may be a spider, as illustrated, a collar load support system, an elevator, or other similar device, may be used to handle and support a tubular member. A fluid dispensing system may then be connected or otherwise coupled to the apparatus 1301 to clean a tubular member supported by the apparatus 1301. As such, the system 1370 may be used to control the apparatus 1301 and/or the fluid dispensing system coupled thereto, such as to selectively dispense fluid from the fluid dispensing system when the tubular member is present within and supported by the apparatus 1301.

The system 1370 may include a console 1372 that may be coupled to one or more sources, such as a pneumatic and/or hydraulic source, a fluid source, and/or an electric source, that may be used to control and operate one or more components of the apparatus 1301 and the fluid dispensing system coupled thereto. One or more connections or outlets 1374 may be included within the console 1372 to couple the apparatus 1301 and the fluid dispensing system to the sources from the console 1372. For example, the outlets 1374 may control one or more different operations of the apparatus 1301 and the fluid dispensing system, such as by controlling the movement of the slip assemblies within the apparatus 1301 and/or preventing movement of the slip assemblies within the apparatus 1301 (e.g., interlocking the slip assemblies in place).

Further, the system 1370 may include a panel 1376 to monitor and/or control one or more variables of the system 1370, such as to monitor and control pressures and flow rates of the sources provided between the console 1372 and the apparatus 1301. The panel 1376 may have a visual display to monitor the one or more variables of the sources provided to the apparatus 1301, such as to monitor the pressure and flow rate of the fluid source (e.g., high pressure water source), hydraulic source, and air source supplied to the apparatus 1301. Further, the panel 1376 may include a plurality of inlets 1378 and outlets 1380 when monitoring and/or controlling one or more variables of the system 1370.

Furthermore, the system 1370 may include one or more control valves 1382 included therewith, such as to control the supply of one or more sources to the apparatus 1301 and the fluid dispensing system. As shown, the control valve 1382 in FIG. 13 may be coupled to the panel 1376 and/or the console 1372 to control the control valve 1382, and a source, such as the fluid source, may then be coupled to the control valve 1382. As such, the control valve 1382 may be operated to control the flow of fluid from the fluid source provided to the apparatus 1301. The apparatus 1301 may include a plurality of inlets 1384, as shown, to receive one or more sources thereto in controlled pressures, flow rates, and/or volumes. For example, the inlets 1384A may be used to receive the hydraulic source and/or pneumatic source therethrough, such as to control the movements of the slip assemblies within the apparatus 1301. Further, the inlets 1384B may be used to receive the fluid source (e.g., high pressure water source) therethrough, such as to provide fluid to the water dispensing system when cleaning a tubular within the apparatus 1301. Additionally, as shown, one or more hoses, pipes, or tubes may be used to couple the components of the system 1370 to each other, such as by coupling and connecting the apparatus 1301 to the console 1372, the panel 1376, and/or the control valve 1382. Those having ordinary skill in the art will appreciate that other arrangements, configurations, and components may be included within one or more embodiments of a system without departing from the scope of the present disclosure.

Figure 10:
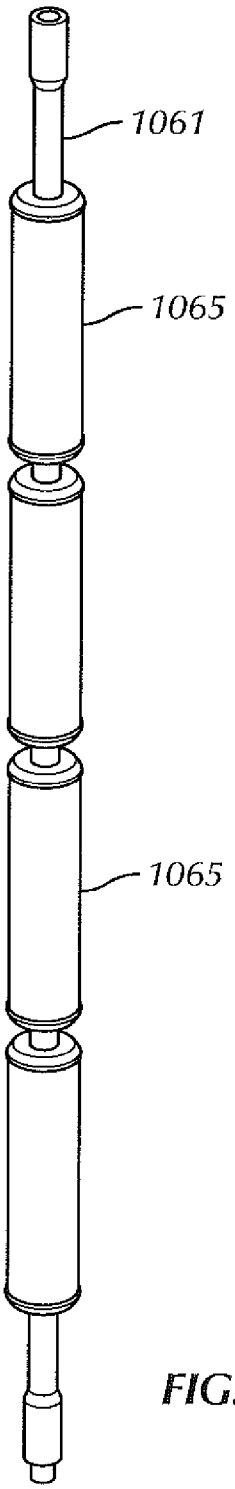
FIG. 10 shows a perspective view of a string of tubular members in accordance with one or more embodiments disclosed herein.

Referring now to FIG. 10, a string of tubular members 1061 having one or more floatation modules 1065 connected thereto in accordance with one or more embodiments of the present disclosure is shown. A string of tubular members may be heavy, in the magnitude of several hundreds of thousands of pounds. To offset at least some of the weight of the string (which may include a casing string or other tubular string hung from a distal end thereof), floatation modules 1065 have been developed that may be connected to or otherwise disposed about (e.g., about the OD of) a tubular member 1061. One or more floatation modules 1065 may be connected to the tubular member 1061, such as by having a hinge formed on one side of the floatation module 1065 that enables the floatation module 1065 to, for example, clasp around the tubular member 1061 from a lateral side thereof. Additionally or alternatively, a floatation module may be attached or applied to the tubular member, such as by applying as a coating or attached via other means, e.g., adhesive, to retain the floatation module stationary with respect to the tubular member. Depicted floatation modules 1065 have a generally circular profile (e.g., a cylinder). However, floatation modules 1065 may have any shape, such as a rectangular or hexagonal profile or spherical shape, which enables the floatation modules to connect to the tubular member 1061.

A floatation module is commonly formed from a buoyant material or buoyant structure, such as having foam (e.g., high density foam) or plastic and/or having a housing with a fluid (e.g., gas) disposed therein for buoyancy. As such, this buoyant material or buoyant structure for the floatation module 1065 may be used to offset at least some of the weight of the tubular member 1061, e.g., from the drilling rig, and thus a tubular string altogether, as the floatation module 1065 may be connected to the tubular member 1061. A floatation module 1065 may be used within the water, e.g., seawater of an offshore drilling operation, and/or a floatation module 1065 may be disposed within a wellbore, including the riser, in land or offshore drilling operations. As such, a floatation module 1065 may provide a buoyancy force when disposed within water and/or mud of a drilling operation, in which the buoyancy force of the floatation modules 1065 may be used to offset at least some of the weight of the tubular string, such as from the drilling rig 101 shown in FIG. 1.

Accordingly, as floatation modules, or other devices, may be attached to one or more tubular members, an apparatus in accordance with the present disclosure may be able to accommodate such modules and devices. Further, with reference to FIG. 11 (and also referenced in FIGS. 9A and 9B with reference numerals 951), an apparatus 1101, such as a pipe handling apparatus (e.g., spider), that may include one or more guiding members 1151 in accordance with one or more embodiments of the present disclosure is shown. The guiding members 1151 may be disposed adjacent to one or more ends or openings 1107 and 1109 of the bore (e.g., defined by bowl 1103), slip assemblies 1121, and/or to a support ring 1111. As such, the guiding members 1151 may be used to guide a tubular member 1161 having a floatation module 1165, or other device, attached thereto through the apparatus 1101. Accordingly, a fluid dispensing system 1131 included with the apparatus 1101 may be used to dispense and direct fluid onto the tubular member 1161 and/or floatation module 1165 for cleaning purposes.

Further, in an embodiment in which the apparatus 1101 includes other devices or apparatuses included therewith, the dispensing system 1131 may be used to dispense and direct fluid onto these other devices and apparatuses for cleaning purposes. For example, in an embodiment in which the apparatus 1101 includes an apparatus or device that may be used to wipe a tubular member, such as the apparatus 300 shown and discussed in FIGS. 3A and 3B, or an apparatus or device that may be used to guide a pipe, such as the pipe guide 702 of FIG. 7, the fluid dispensing system 1131 may additionally or alternatively be used to dispense and direct fluid onto these devices and apparatuses for cleaning purposes.

Figure 11:
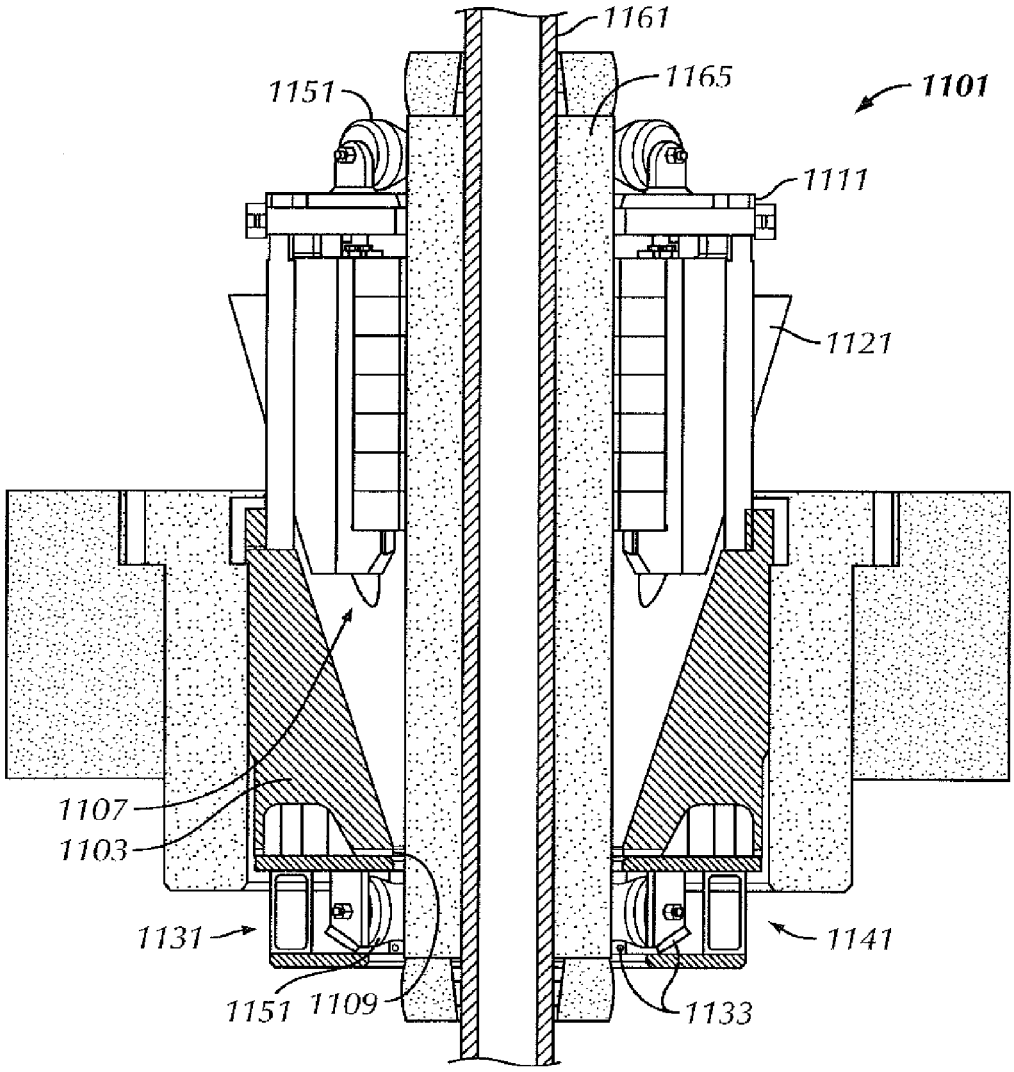
FIG. 11 shows a cross-sectional view of an apparatus to clean a tubular member in accordance with one or more embodiments disclosed herein.

In FIG. 11, the guiding members 1151 are shown as connected to the support ring 1111 disposed adjacent to the top opening 1107 of the bowl 1103, and are also shown as disposed adjacent to the bottom opening 1109 of the bowl 1103. As such, in one or more embodiments, the guiding members 1151 may be included with or disposed adjacent to the fluid dispensing system 1131, such as by having the nozzles 1133 disposed adjacent and arranged around the guiding members 1151 at the bottom opening 1109. An example of arrangements and uses of guiding members is disclosed in U.S. Pat. No. 8,316,929, issued on Nov. 27, 2012, entitled "Tubular Guiding and Gripping Apparatus and Method," in which this application is incorporated herein by reference in its entirety. Further, the present disclosure contemplates using the fluid dispensing system of the present disclosure with other structures and apparatuses that may be used to support and/or clean a tubular member. An example of a such an apparatus that may be used with the present fluid dispensing system is disclosed in U.S. patent application Ser. No. 13/331,759, filed on Dec. 20, 2011, entitled "Apparatus to Wipe a Tubular Member," in which this application is incorporated herein by reference in its entirety.

As shown in FIG. 11, the apparatus 1101 may include a plate assembly 1141, such as by having the plate assembly 1141 connected adjacent to the bottom opening 1109 of the apparatus 1101. The plate assembly 1141 may be used to include the fluid dispensing system 1131, as shown, in which the nozzles 1133 may be disposed within and/or attached to the plate assembly 1141. Additionally, or alternatively, the fluid dispensing system 1131 may be used to attach to the plate assembly 1141, such as by having the fluid dispensing system 1131 connect to the plate assembly 1141. Similarly, if other mechanisms or devices are used in conjunction with the apparatus 1101, such as the guiding members 1151, the mechanism and devices may be disposed within the plate assembly 1141 or separately connected and attached thereto. As such, in one or more embodiments, the plate assembly, or another similar assembly, may be used as a structure to couple mechanisms and devices thereto for use with the apparatus, such as by coupling the fluid dispensing system, guiding members, alignment members, cleaning members, and/or any other members or systems to the apparatus through the use of the plate assembly. Additionally, or alternatively, the plate assembly, or another similar assembly, may be used to support and/or protect the apparatus, such as by using the plate assembly to rest the apparatus upon when not in use or when in transport. An example of a plate assembly is disclosed in U.S. Pat. No. 8,316,929, issued on Nov. 27, 2012, mentioned and incorporated by reference above.

In accordance with one or more embodiments disclosed herein, a fluid receiving system may be used with and/or incorporated with the fluid dispensing system. For example, as the fluid dispensing system is used to dispense fluid therefrom, the fluid receiving system may be used to receive fluid therein, such as the fluid dispensed from the fluid dispensing system when used to clean a tubular member or other device. As such, the fluid receiving system may be disposed adjacent to the fluid dispensing system to receive the fluid from fluid dispensing system into at least one inlet of the fluid receiving system. Further, the fluid receiving system may further include a suction pump and/or flow facilitating structures or devices, such as a funnel, to prevent excess spillage of the fluid dispensing system and facilitate receiving the fluid within the fluid receiving system. Thus, in one embodiment, the fluid receiving system may use a suction pump to draw fluid used to clean a tubular member away from the tubular member and into an inlet of the fluid receiving system. The fluid may then be cleaned, disposed of, or otherwise handled as desired, thereby preventing the fluid from the fluid dispensing system from creating a hazard when in use.

For example, as shown in FIGS. 9A and 9B, a fluid receiving system 940 may be used with and/or incorporated with the fluid dispensing system 931. For example, as the fluid dispensing system 931 is used to dispense fluid therefrom, the fluid receiving system 940 may be used to receive fluid therein, e.g., from a fluid source 946, such as the fluid dispensed from the fluid dispensing system 931 when used to clean a tubular member or other device. As such, the fluid receiving system 940 may be disposed adjacent to the fluid dispensing system 931 to receive the fluid from fluid dispensing system 931 into at least one inlet 945 of the fluid receiving system 940. Further, the fluid receiving system 940 may further include a suction pump 943 and/or flow facilitating structures or devices, such as a funnel, to prevent excess spillage of the fluid dispensing system 931 and facilitate receiving the fluid within the fluid receiving system 940. Thus, in one embodiment, the fluid receiving system 940 may use a suction pump 943 to draw fluid, e.g., from the fluid source 946, used to clean a tubular member away from the tubular member and into an inlet of the fluid receiving system 940. The fluid may then be cleaned, disposed of, or otherwise handled as desired, thereby preventing the fluid from the fluid dispensing system from creating a hazard when in use.

Figure 12:
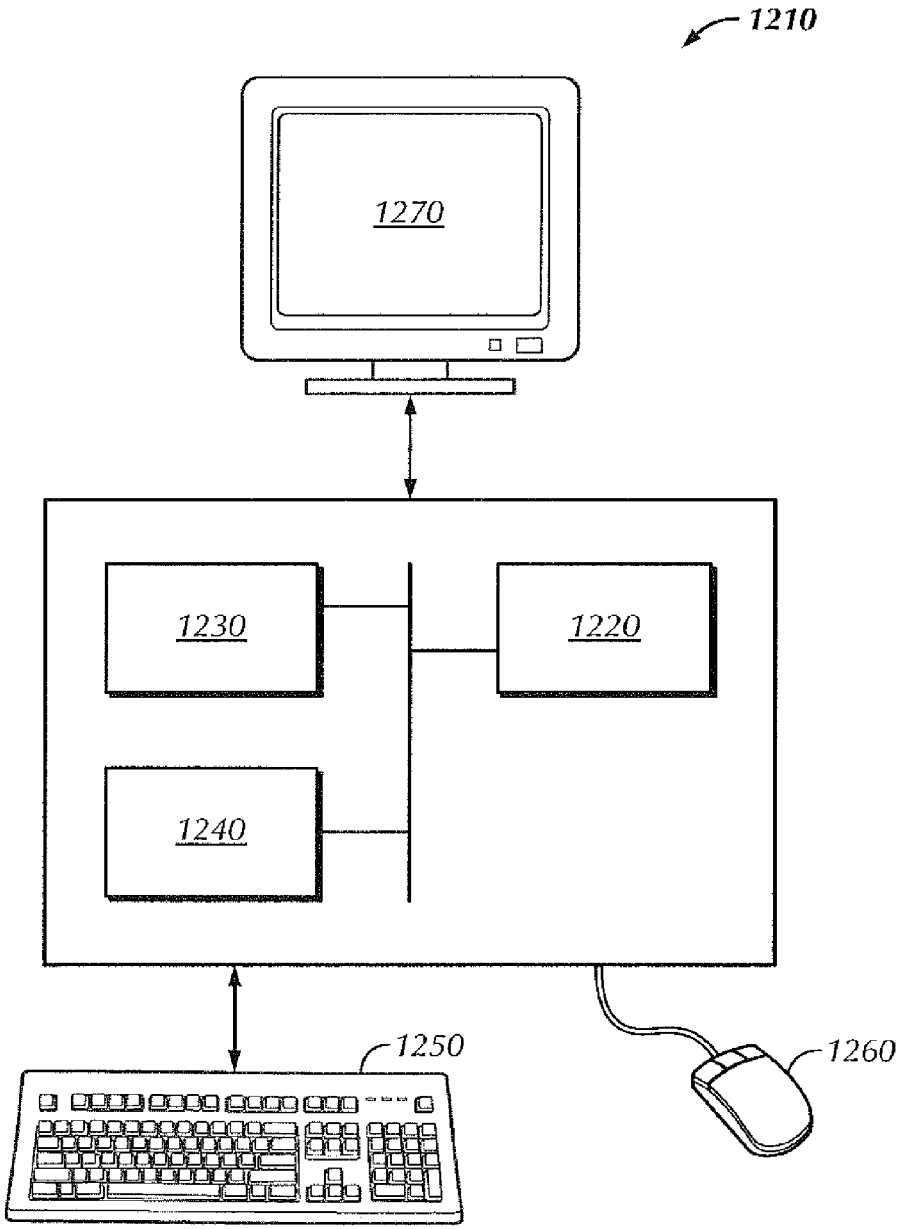
FIG. 12 shows a computer system that may be used in accordance with an embodiment disclosed herein.

Accordingly, aspects of embodiments disclosed herein, such as controlling and/or moving one or more nozzles, valves, slip assemblies, actuators and/or controlling and moving any other components of an apparatus to support and handle tubular members, may be implemented on any type of control system, e.g., hydraulic, pneumatic, electric and/or mechanical system. A control system may comprise sensor(s) and/or actuator(s). A control system may also comprise a computer regardless of the platform being used. For example, as shown in FIG. 12, a networked computer system 1210 that may be used in accordance with an embodiment disclosed herein includes a processor 1220, associated memory 1230, a storage device 1240, and numerous other elements and functionalities typical of today's computers (not shown). The networked computer system 1210 may also include input means, such as a keyboard 1250 and a mouse 1260, and output means, such as a monitor 1270. The depicted networked computer system 1210 is connected to a local area network (LAN) or a wide area network (e.g., the Internet) (not shown) via a network interface connection (not shown). Those skilled in the art will appreciate that these input and output means may take many other forms. Additionally, the computer system may not be connected to a network. Further, those skilled in the art will appreciate that one or more elements of aforementioned computer 1210 may be located at a remote location and connected to the other elements over a network. As such, a computer system, such as the networked computer system 1210, and/or any other computer system known in the art may be used in accordance with embodiments disclosed herein.

One having ordinary skill in the art will appreciate that one or more of the above embodiments may be used in combination with each other. For example, a pipe handling apparatus may include an apparatus to wipe a tubular member, as shown and discussed with respect to FIGS. 3A and 3B, may include a pipe guide and wear sensor, as shown and discussed with respect to FIG. 7, and/or may include a fluid dispensing system, as shown and discussed with respect to FIGS. 9A and 9B. As such, a pipe handling apparatus in accordance with the present disclosure, in addition to any of the other apparatuses, devices, or systems that may be included with the pipe handling apparatus, may be capable of handling multiple sizes of tubular members, and/or may be capable of handling tubular members having devices attached thereto.

For example, as shown in FIG. 10, the tubular member 1061 may include the floatation module 1065 connected thereto. A pipe handling apparatus in accordance with the present disclosure may be capable of handling a tubular member, such as by having slip assemblies engage the tubular member 1065, while the slip assemblies are capable of being moved far enough away from the axis of the pipe handling apparatus such that the tubular member 1065 with the floatation module 1065 attached thereto are not damaged from any contact with the slip assemblies. In one or more embodiments, a tubular member, such as drill pipe, may have an outer diameter of six and five-eighths inches (16.83 cm), or smaller, while a floatation module may have an outer diameter of fifteen and one-half inches (39.4 cm), or larger. As such, a pipe handling apparatus in accordance with the present disclosure may be capable of handling tubular members having similar sizes while also accommodating and preventing or limiting damage to floatation modules that are larger in size. Further, in an embodiment in which an apparatus to wipe a tubular member is included with a pipe handling apparatus, the apparatus to wipe the tubular member may be sized and/or configured to wipe a floatation module, or any other device, that may be connected to a tubular member. Thus, such an apparatus may be capable of assisting in cleaning tubular members having multiple diameters, in addition to tubular members that may have any devices connected thereto, such as a buoyancy module.

An apparatus in accordance with one or more embodiments of the present disclosure may be useful in multiple areas of drilling. For example, as the apparatus may be disposed adjacent to a pipe handling apparatus, the apparatus may be used to engage and wipe tubular members received within the pipe handling apparatus. This may remove fluid and/or debris (e.g., oil-based and/or water-based mud) from the outer surfaces of the tubular members, thereby increasing the reliability and longevity of the pipe handling apparatus.

As the wiper sections are removably connected within the apparatus, the wiper sections may be replaced at a desired rate and/or as needed. For example, as the wiper sections of the wiper apparatus include flexible materials and components, the wiper sections may need to be removed and replaced regularly, depending on use. Furthermore, as the apparatus may include one or more position sensors therein, the position sensors may be used to determine if one or more components within the apparatus is moving properly.

Further, as the apparatus may be disposed adjacent to a pipe handling apparatus, the apparatus may be used to sense wear within a pipe guide and indicate when the pipe guide may need to be replaced. In one embodiment, the apparatus may be disposed adjacent to a bottom side and a bottom opening of a pipe handling apparatus, as the bottom opening of a pipe handling apparatus having a pipe guide may be difficult to visually inspect and verify that the pipe guide is in proper working condition. As such, an apparatus in accordance with the present disclosure may be used and disposed adjacent to the bottom side of the pipe handling apparatus to sense and indicate to a user when a pipe guide may need to be replaced. Further, as the pipe guide includes sections that are removably connected within the apparatus, the sections may be replaced at a desired rate and/or as needed. For example, as the pipe guide sections include a wearable material, the sections may need to be removed and replaced regularly, depending on use.

Furthermore, in one or more embodiments, as the apparatus may be disposed adjacent to an apparatus to handle and support tubular members, the apparatus may be used to engage and at least partially clean tubular members received within such an apparatus. This may remove fluid and/or debris (e.g., oil-based and/or water-based mud) from the outer surfaces of the tubular members, thereby increasing the reliability and longevity of the apparatus handling and supporting the tubular members. Furthermore, as the apparatus may include one or more actuators coupled thereto, such as by having actuators coupled to the nozzles of the fluid dispensing system, the actuators may be used to selectively control and operate the fluid dispensing system, as desired. For example, the fluid dispensing system may be controlled, such as remotely controlled, to adjust the position of one or more nozzles, but also adjust the flow rate through one or more nozzles.

While the present disclosure has been described with respect to a limited number of embodiments, those skilled in the art, having benefit of this disclosure, will appreciate that other embodiments may be devised which do not depart from the scope of the disclosure as described herein. Accordingly, the scope of the disclosure should be limited only by the attached claims.

What is claimed is:

1. A system to clean a tubular member, the system comprising:

an apparatus having a bore with a longitudinal axis extending therethrough to support a tubular member;

a fluid dispensing system disposed adjacent to an opening of the apparatus, the fluid dispensing system having a nozzle to dispense fluid therefrom;

a bowl having a tapered inner wall formed about the longitudinal axis;

a plurality of slip assemblies movably disposed within the bowl;

a fluid inlet to receive fluid therein;

a fluid passage to direct fluid from the fluid inlet to the nozzle of the fluid dispensing system, wherein the fluid inlet is disposed on a top side of the apparatus, and wherein the fluid passage is formed, at least partially, within the bowl.

2. The system of claim 1, wherein the fluid passage comprises a valve to selectively control fluid flow therethrough.

3. The system of claim 1, wherein the nozzle of the fluid dispensing system comprises a plurality of nozzles.

4. The system of claim 3, wherein the plurality of nozzles are substantially equally spaced from one another about the longitudinal axis.

5. The system of claim 1, wherein the nozzle dispenses at least one of a liquid and a gas therefrom, and wherein the liquid is at least one of a water-based liquid and an oil-based liquid.

6. The system of claim 1, wherein the nozzle of the fluid dispensing system is movably connected to the apparatus.

7. The system of claim 6, wherein the nozzle is connected to an actuator to impart movement thereto.

8. The system of claim 1, further comprising:

a fluid receiving system disposed adjacent to the fluid dispensing system, the fluid receiving system having an inlet to receive fluid therein.

9. The system of claim 8, wherein the fluid receiving system comprises a suction pump.

10. The system of claim 1, further comprising:

a first guiding member disposed adjacent to a first opening on a first side of the apparatus; and a second guiding member disposed adjacent to a second opening on a second side of the apparatus.

11. The system of claim 1, wherein the fluid dispensing system comprises a plate assembly.

12. The system of claim 11, wherein the plate assembly is removably connected on a second side of the bowl.

13. An apparatus to clean a tubular member, the apparatus comprising:

a bowl forming a bore and having a tapered inner wall formed about a longitudinal axis;

a plurality of slip assemblies movably disposed within the bowl;

a fluid dispensing system disposed adjacent to an opening of the bowl, the fluid dispensing system having a plurality of nozzles to dispense fluid therefrom;

a fluid inlet disposed on a top side of the bowl to receive fluid therein; and a fluid passage formed, at least partially, within the bowl to direct fluid from the fluid inlet to the plurality of nozzles of the fluid dispensing system.

14. The apparatus of claim 13, wherein the fluid passage comprises a valve to selectively control fluid flow therethrough.

15. The apparatus of claim 13, wherein the plurality of nozzles of the fluid dispensing system are movably connected to the bowl.

16. The apparatus of claim 13, further comprising:

a fluid receiving system disposed adjacent to the fluid dispensing system, the fluid receiving system having a suction pump and an inlet to receive fluid therein.

17. The apparatus of claim 13, wherein the fluid dispensing system comprises a plate assembly, and wherein the plate assembly is removably connected on a second side of the bowl.

18. A method to manufacture a system to clean a tubular member, the method comprising:

providing an apparatus having a bore with a longitudinal axis extending therethrough to support the tubular member;

disposing a fluid dispensing system adjacent to an opening of the apparatus, the fluid dispensing system having a nozzle to dispense fluid therefrom;

a bowl having a tapered inner wall formed about the longitudinal axis;

a plurality of slip assemblies movably disposed within the bowl;

disposing a fluid inlet on a top side of the apparatus to receive fluid therein; and forming a fluid passage, at least partially, within the bowl of the apparatus to direct fluid from the fluid inlet to the nozzle of the fluid dispensing system.

19. The method of claim 18, further comprising:

disposing a valve within the fluid passage to selectively control fluid flow therethrough.

20. The method of claim 18, wherein the nozzle of the fluid dispensing system comprises a plurality of nozzles.

21. The method of claim 18, wherein disposing the fluid dispensing system adjacent to the opening of the apparatus comprises movably disposing the nozzle adjacent to the opening of the apparatus.

22. The method of claim 18, further comprising:

disposing a fluid receiving system adjacent to the fluid dispensing system, the fluid receiving system having an inlet to receive fluid therein.

23. The method of claim 18, wherein the fluid dispensing system comprises a plate assembly, and wherein disposing the fluid dispensing system adjacent to the opening of the apparatus comprises removably disposing the plate assembly adjacent to the opening of the apparatus.

* * * * *